US006512335B1

(12) United States Patent
Dunphy et al.

(10) Patent No.: US 6,512,335 B1
(45) Date of Patent: Jan. 28, 2003

(54) CATHODE BURN-IN PROCEDURES FOR A FIELD EMISSION DISPLAY THAT AVOID DISPLAY NON-UNIFORMITIES

(75) Inventors: James C. Dunphy, San Jose, CA (US); William J. Cummings, San Francisco, CA (US); Colin D. Stanners, San Jose, CA (US); Lawrence S. Pan, Los Gatos, CA (US)

(73) Assignee: Candescent Technologies Corporation, San Jose, CA (US)

( * ) Notice: Subject to any disclaimer, the term of this patent is extended or adjusted under 35 U.S.C. 154(b) by 0 days.

(21) Appl. No.: 09/896,402

(22) Filed: Jun. 28, 2001

Related U.S. Application Data

(63) Continuation-in-part of application No. 09/796,868, filed on Feb. 28, 2001, which is a continuation-in-part of application No. 09/493,698, filed on Jan. 28, 2000, now Pat. No. 6,301,325, which is a continuation of application No. 09/144,675, filed on Aug. 31, 1998, now Pat. No. 6,104,139.

(51) Int. Cl.[7] ..... G09G 3/10

(52) U.S. Cl. ..... 315/169.3; 315/169.1; 315/169.4; 313/496; 313/497; 345/74; 345/75

(58) Field of Search ..... 315/169.3, 169.1, 315/169.4; 313/496, 497, 495; 345/74, 75, 76, 77

(56) References Cited

U.S. PATENT DOCUMENTS 5,587,720 A * 12/1996 Fukuta et al. ..... 313/309
5,656,889 A 8/1997 Niiyama et al. ..... 313/553
5,721,560 A * 2/1998 Cathey et al. ..... 313/495
5,835,991 A 11/1998 Niiyama et al. ..... 313/553

* cited by examiner

*Primary Examiner*—Don Wong
*Assistant Examiner*—Tuyet T. Vo
(74) *Attorney, Agent, or Firm*—Wagner, Murabito & Hao LLP

(57) ABSTRACT

Methods for performing cathode burn-in with respect to an FED display that avoid display non-uniformities near and around the spacer wall structures. In a first method, the anode is floated or receives a negative voltage with respect to the electron emitter. A positive voltage is then applied to the focus waffle structure with respect to the electron emitter. The cathode is then energized thereby preventing emitted electrons from escaping the focus well. Under these conditions, cathode burn-in conditioning can occur but electrons are energetically forbidden from hitting the anode or the spacer walls except for a small region near the focus waffle. Under the second method, the anode is grounded or allowed to float. A negative bias is applied to the focus waffle. This causes electrons to be collected at the M2 layer of the gate. Electrons are energetically forbidden from hitting any portion of the tube except the M2 layer. Under either method, no electrons hit the spacer walls and therefore display non-uniformities near and around the spacer wall structures are avoided.

33 Claims, 16 Drawing Sheets

CATHODE BURN-IN PROCEDURES FOR A FIELD EMISSION DISPLAY THAT AVOID DISPLAY NON-UNIFORMITIES

RELATED US PATENT APPLICATIONS

The following patent application is a continuation-in-part of U.S. patent application Ser. No. 09/796,868, filed on Feb. 28, 2001 which is a continuation-in-part of copending U.S. patent application Ser. No. 09/493,698, filed on Jan. 28, 2000 now U.S. Pat. No. 6,301,325 which is a continuation patent application of U.S. patent application Ser. No. 09/144,675, filed on Aug. 31, 1998 which is now U.S. Pat. No. 6,104,139 (all of which are hereby incorporated herein by reference).

FIELD OF THE INVENTION

The present invention pertains to the field of flat panel display screens. More specifically, the present invention relates to the field of flat panel field emission display screens.

BACKGROUND OF THE INVENTION

Flat panel field emission displays (FEDs), like standard cathode ray tube (CRT) displays, generate light by impinging high energy electrons on a picture element (pixel) of a phosphor screen. The excited phosphor then converts the electron energy into visible light. However, unlike conventional CRT displays which use a single or in some cases three electron beams to scan across the phosphor screen in a raster pattern, FEDs use stationary electron beams for each color element of each pixel. This requires the distance from the electron source to the screen to be very small compared to the distance required for the scanning electron beams of the conventional CRTs. In addition, FEDs consume far less power than CRTs. These factors make FEDs ideal for portable electronic products such as laptop computers, pagers, cell phones, pocket-TVs, personal digital assistants, and portable electronic games.

One problem associated with the FEDs is that the FED vacuum tubes may contain minute amounts of contaminants which can become attached to the surfaces of the electron-emissive elements, faceplates, gate electrodes, focus electrodes, (including dielectric layer and metal layer) and spacer walls. These contaminants may be knocked off when bombarded by electrons of sufficient energy. Thus, when an FED is switched on or switched off, there is a high probability that these contaminants may form small zones of high pressure within the FED vacuum tube.

In addition, electron emission from the emitter electrodes to the gate electrodes can cause both emitter and gate degradation. For instance, the gate is positive with respect to the emitter causing an attraction of electrons from the emitter electrodes to the gate electrodes. In addition, the presence of the high pressure facilitates electron emission from emitters to gate electrodes. The result is that some electrons may strike the gate electrodes rather than the display screen. This situation can lead to gate electrode degradation including overheating of the gate electrodes. The emission to the gate electrodes can also affect the voltage differential between the emitters and the gate electrodes. Electron emission from the emitter electrodes to the gate electrodes can also cause ions and other material debris to be released from the gate and thereby become attached to the emitter electrode. This can cause emitter degradation.

It is worth noting that electrons may also hit spacer walls and focus electrodes, causing non-uniform emitter degradation. Problems occur when electrons hit any surface except the anode, as these other surfaces are likely to be contaminated and outgas because they are not scrubbed by the electron beam during normal tube operation. In addition, as the electrons jump the gap between the electron-emissive elements and the gate electrode, a luminous discharge of current may also be observed. Severe damage to the delicate electron-emitters may also result. Naturally, this phenomenon, generally known as "arcing," is highly undesirable.

Conventionally, one method of avoiding the arcing problem is by manually electron scrubbing the FED vacuum tubes to remove contaminant material. However, it is difficult to remove all contaminants with that method. Further, the process of manual scrubbing is time-consuming and labor intensive, unnecessarily increasing the fabrication cost of FED screens.

Cathode burn-in is a technique to condition a FED screen. FIG. 1 is a cross section structural view of part of a flat panel FED unit 75 that utilizes a gated field emitter 40 with spacer walls 17 and a focus waffle 10. The electron emitter 40 is electrically coupled to a cathode structure 60. During the cathode burn-in process, the emitter current is gradually raised up to its normal full bright level and the anode 20 is generally held to a low voltage, e.g., 750 volts, which is just high enough for electrons emitted from the emitter 40 to escape the focus wells 11, but low enough to minimize the occurrences of damaging arcs. Cathode burn-in is a conditioning step and is typically performed after the tube has been sealed but not yet run.

The process of cathode burn-in performs at least two functions which cannot be performed well at high anode voltage conditions. The first is that cathode burn-in techniques forward bias the emitters 40 and allow inevitable "blow-outs" (e.g., shorts) to occur under low anode voltage conditions where they are much less likely to cause damaging faceplate-cathode arcs described above. The second function performed by cathode burn-in techniques is that they perform an important out-gassing function by cracking and pumping non-getterable gases with emitted electrons. For instance, cathode burn-in techniques ionize gases thereby making them more reactive and therefore more likely to be captured by the getter or other parts of the display. Further, by ionizing the gases, they are driven into the faceplate and are thereby pumped. Typically, the tubes begin cathode burn-in with a high pressure ($10^{-4}$ Torr) of methane gas which is mostly pumped away by the end of cathode burn-in.

A serious problem with prior art cathode burn-in techniques stems from emitted electrons hitting the spacer walls 17 (FIG. 1) thereby causing display non-uniformities near the spacer walls. During cathode burn-in, the emitters near the spacer walls experience a different concentration of gas molecules and ion sputtering than those located away from the spacer walls. This is a result of the high gas pressure in the tube and the low voltage applied to the anode 20. This difference causes display non-uniformities in the tube after cathode burn-in. These unwanted display non-uniformities in the tube may persist or emerge later in the life of the tube.

The low anode voltage applied during cathode burn-in allows the electron beam 14 to spread out more than during normal high anode voltage operation so many electrons 12*a*, 12*b* hit the spacer walls 17. When hit by low energy electrons (e.g., <1000 ev), the spacers walls emit secondaries and charge. The charged walls 17 deflect the electrons causing a non-uniform current density into the faceplate 70 near the spacer walls 17. This causes non-uniform faceplate outgassing which may effect nearby emitters. The spacer walls 17 also may outgas under electron bombardment. The secondary electrons from the spacer walls themselves 17 ionize gas molecules which sputter the cathode adjacent to the spacer wall more than those that are located further away. Typically, these anomalies near the spacer walls 17 cause the rows around the spacer walls (e.g., for spacers running in the direction of the rows) to emit more electrons than those further from the spacer walls by the end of cathode burn-in conditioning thereby causing display non-uniformities.

SUMMARY OF THE DISCLOSURE

Accordingly, it would be advantageous to reduce or eliminate the display non-uniformities described above while maintaining the benefits of cathode burn-in conditioning. Embodiments of the present invention are directed as alternatives to cathode burn-in conditioning which prevent these non-uniformities by collecting the emitted electrons at the cathode so that very few or none of the emitted electrons hit the spacer walls of the faceplate. According to the present invention, the electrons can be collected either by the metal layers of the cathode or by the focus waffle. By preventing electrons from hitting the spacer walls during cathode burn-in conditioning, the present invention reduces or eliminates the display non-uniformities described above while maintaining the benefits of cathode burn-in. These and other advantages of the present invention not specifically described above will become clear within discussions of the present invention herein.

Methods for performing cathode burn-in with respect to an FED display are described herein that avoid display non-uniformities near and around the spacer wall structures. In a first method, the anode is floated or receives a negative voltage (e.g., 100–500 volts or more) with respect to the electron emitter. A positive voltage (e.g., 40–100 volts, for instance) is then applied to the focus waffle structure with respect to the electron emitter. The cathode is then energized (e.g., 30 volts) thereby preventing emitted electrons from escaping the focus well. Under these conditions, cathode burn-in conditioning can occur but electrons are energetically forbidden from hitting the anode or the spacer walls except for a small region near the focus waffle.

Under the second method, the anode is grounded or allowed to float. A negative bias is applied to the focus waffle (e.g., 20 volts or more with respect to the emitters). This causes electrons to be collected at the M2 layer of the gate. Under these conditions, the negative focus voltage "pinches off" the potential of the top of the focus waffle so that no electrons can escape out to hit the faceplate or wall. Electrons are energetically forbidden from hitting any portion of the tube except the M2 layer.

Under either method, no electrons hit the spacer walls and therefore display non-uniformities near and around the spacer wall structures are avoided. Also, under either method, metal layers M1 and M2 of the gate are biased under the usual operating conditions of the tube so that electrons are emitted from the tips. As with normal cathode burn-in procedures, inevitable "blow-outs" can occur and the emitted low energy electrons will crack non-getterable gas molecules. The tube can operate in conditioning mode from the normal period of cathode burn-in, e.g., about 1 hour.

More specifically, a first embodiment of the present invention is directed toward a method for performing cathode conditioning with respect to a field emission display device comprising: rows and columns of pixels; an anode electrode; a focus waffle structure; and spacer walls disposed between the anode electrode and the focus waffle structure, wherein each of the pixels comprises respective emitter and gate electrodes, the method comprising the steps of: a) biasing the focus waffle structure with a positive voltage with respect to the emitter electrode; b) biasing the anode electrode with a voltage level that is floating or negative; and c) biasing the emitter electrode such that electrons are emitted from tips of the emitter electrode, wherein the emitted electrons are directed toward the focus waffle structure and are energetically forbidden from reaching any substantial portion of the spacer walls. As one example, the positive voltage of step a) is within the range of approximately 40 to 100 volts and the anode electrode is biased to a negative voltage level within the range of approximately 100 to 500 volts at the step b).

A second embodiment of the present invention is directed toward a method for performing cathode conditioning with respect to a field emission display device comprising: rows and columns of pixels; an anode electrode; a focus waffle structure; and spacer walls disposed between the anode electrode and the focus waffle structure, wherein each of the pixels comprises respective emitter and gate electrodes, the method comprising the steps of: a) biasing the focus waffle structure with a negative voltage with respect to the emitter electrode; b) biasing the anode electrode with a voltage level that is floating or grounded; and c) biasing the emitter electrode such that electrons are emitted from tips of the emitter electrode, wherein the emitted electrons are directed toward the gate electrode and are energetically forbidden from reaching any substantial portion of the spacer walls. As one example, the negative voltage of step a) is within the range of approximately 20 volts or more.

In either embodiment, the emitter electrode comprises a first metal layer and a second metal layer and wherein the step c) comprises the step of: c1) over a first time period, ramping a bias voltage (the "ramp") applied across the first and second metal layers from a first predetermined level to a second predetermined level; and c2) over a second time period, maintaining the second ("the soak") predetermined level.

A third embodiment of the present invention is directed toward a method for performing cathode conditioning with respect to a field emission display device comprising: rows and columns of pixels; an anode electrode; a focus waffle structure; and spacer walls disposed between the anode electrode and the focus waffle structure, wherein each of the pixels comprises respective emitter and gate electrodes, the method comprising the steps of: performing a cathode conditioning process of a first duration before the field emission display device is used for normal display operations; and upon subsequent normal power-on of the field emission display device, performing cathode re-conditioning process of a second duration, wherein the second duration is significantly shorter than the first duration and wherein the conditioning and reconditioning processes described above may be performed using the first or second embodiment described above.

BRIEF DESCRIPTION OF THE DRAWINGS

The accompanying drawings, which are incorporated in and form a part of this specification, illustrate embodiments of the present invention and, togeather with the description, serve to explain the principles of the invention.

DETAILED DESCRIPTION OF THE PREFERRED EMBODIMENTS

Reference will now be made in detail to the present embodiments of the invention, examples of which are illustrated in the accompanying drawings, and include a method for performing cathode burn-in with respect to an FED display that avoids display non-uniformities near and around the spacer wall structures. While the invention will be described in conjunction with the present embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following description, for purposes of explanation, numerous specific details are set forth in order to provide a thorough understanding of the present invention. It will be apparent, however, to one skilled in the art, upon reading this disclosure, that the present invention may be practiced without these specific details. In other instances, well-known structures and devices are not described in detail in order to avoid obscuring aspects of the present invention.

The following patent applications are hereby incorporated herein by reference: U.S. patent application Ser. No. 09/796,868, filed on Feb. 28, 2001; U.S. patent application Ser. No. 09/493,698, filed on Jan. 28, 2000; and U.S. patent application Ser. No. 09/144,675, filed on Aug. 31, 1998 which is now U.S. Pat. No. 6,104,139.

GENERAL DESCRIPTION OF FIELD EMISSION DISPLAYS

Figure 2A:
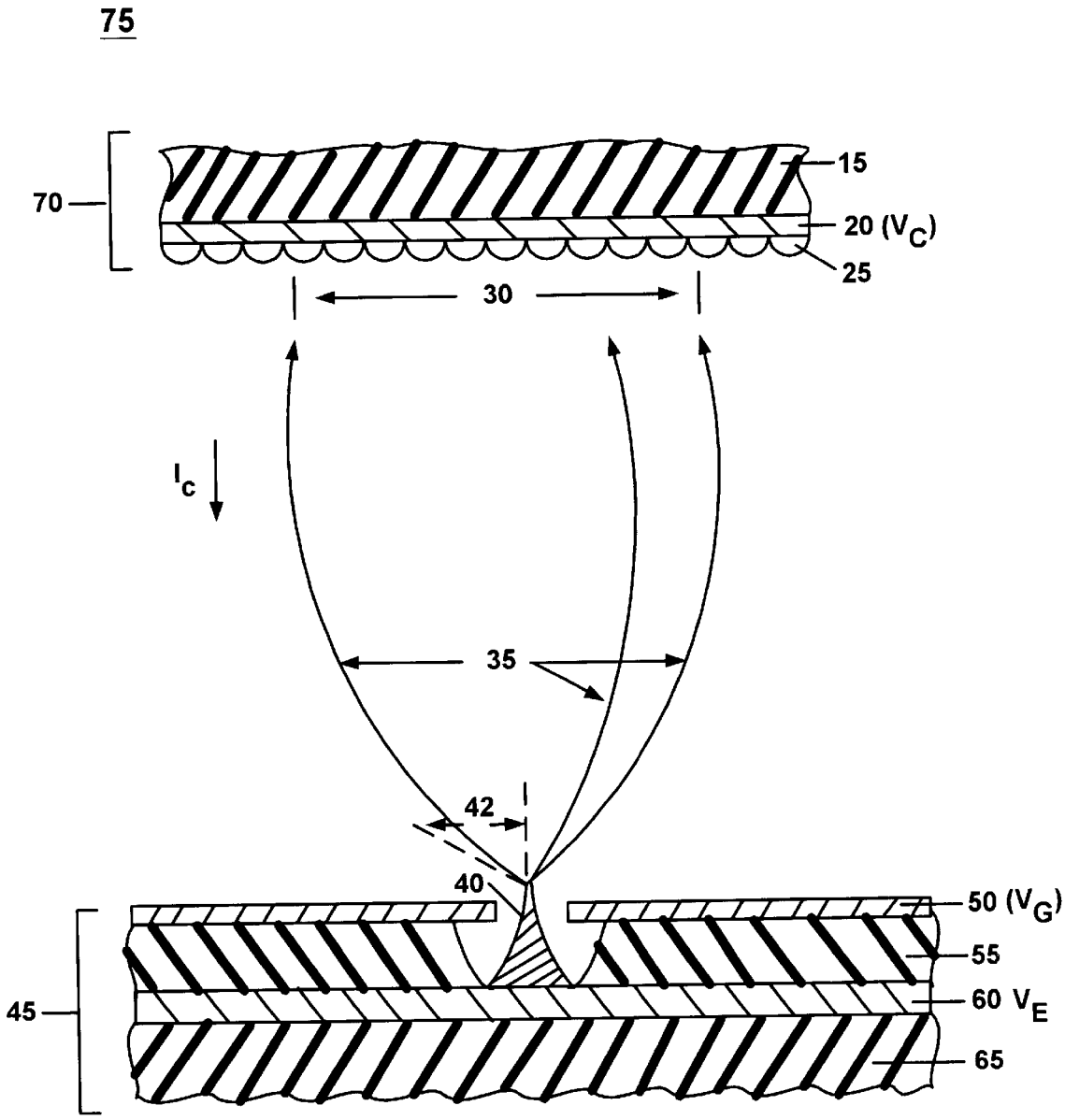
FIG. 2A is a cross section structural view of part of an exemplary flat panel FED screen that utilizes a gated field emitter situated at the intersection of a row line and a column line.

A general description of field emission displays is presented. FIG. 2A illustrates a multi-layer structure 75 which is a cross-sectional view of a portion of an FED flat panel display. The multi-layer structure 75 contains a field-emission backplate structure 45, also called a baseplate structure, and an electron-receiving faceplate structure 70. An image is generated at faceplate structure 70. Backplate structure 45 commonly consists of an electrically insulating backplate 65, an emitter (or cathode) electrode 60, an electrically insulating layer 55, a patterned gate electrode 50, and a conical electron-emissive element 40 situated in an aperture through insulating layer 55.

One type of electron-emissive element 40 is described in U.S. Pat. No. 5,608,283, issued on Mar. 4, 1997 to Twichell et al. and another type is described in U.S. Pat. No. 5,607,335, issued on Mar. 4, 1997 to Spindt et al., which are both incorporated herein by reference. The tip of the electron-emissive element 40 is exposed through a corresponding opening in gate electrode 50. Emitter electrode 60 and electron-emissive element 40 together constitute a cathode of the illustrated portion 75 of the FED flat panel display. Faceplate structure 70 is formed with an electrically insulating faceplate 15, an anode 20, and a coating of phosphors 25. Electrons emitted from element 40 are received by phosphors portion 30. In one embodiment, electron emissive element 40 includes a conical molybdenum tip. In other embodiments of the present invention, the anode 20 may be positioned over the phosphors 25, and the emitter 40 may include other geometrical shapes such as a filament.

The emission of electrons from the electron-emissive element 40 is controlled by applying a suitable voltage ($V_G$) to the gate electrode 50. Another voltage ($V_E$) is applied directly to the electron-emissive element 40 by way of the emitter electrode 60. Electron emission increases as the gate-to-emitter voltage, e.g., $V_G$ minus $V_E$, or $V_{GE}$, is increased. Directing the electrons to the phosphor 25 is performed by applying a high voltage ($V_C$) to the anode 20. When a suitable gate-to-emitter voltage $V_{GE}$ is applied, electrons are emitted from electron-emissive element 40 at various values of off-normal emission angle theta 42. The emitted electrons follow non-linear (e.g., parabolic) trajectories indicated by lines 35 in FIG. 2A and impact on a target portion 30 of the phosphors 25. Thus, $V_G$ and $V_E$ determine the magnitude of the emission current ($I_C$), while the anode voltage $V_C$ controls the direction of the electron trajectories for a given electron emitted at a given angle.

Figure 2B:
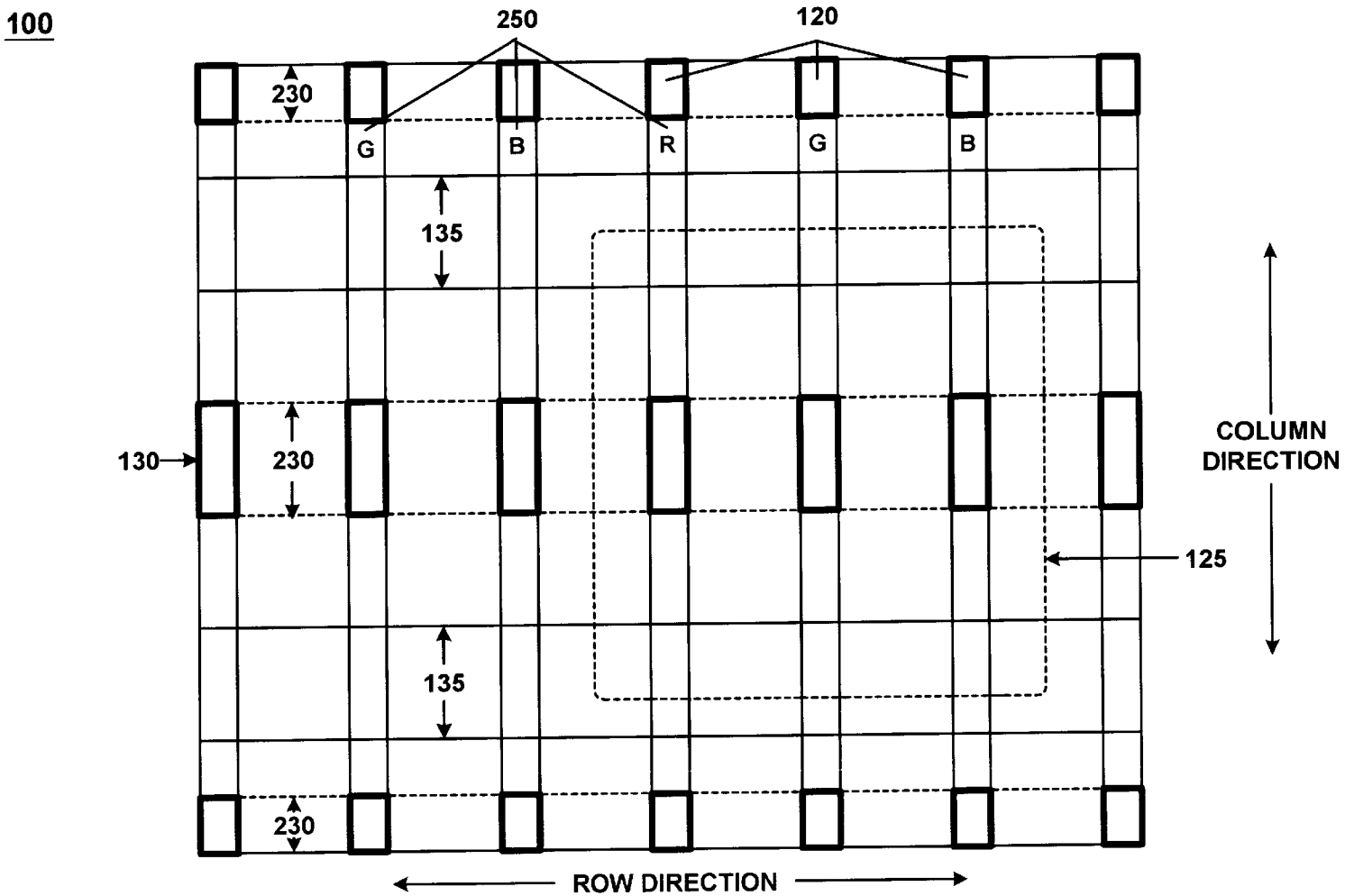
FIG. 2B illustrates an exemplary FED screen in accordance with one embodiment of the present invention.

FIG. 2B illustrates a portion of an exemplary FED screen 100. The FED screen 100 is subdivided into an array of horizontally aligned rows and vertically aligned columns of pixels. The boundaries of a respective pixel 125 are indicated by dashed lines. Three separate row lines 230 are shown. Each row line 230 is a row electrode for one of the rows of pixels in the array. In one embodiment, each row line 230 is coupled to the emitter cathodes of each emitter of the particular row associated with the electrode. A portion of one pixel row is indicated in FIG. 2B and is situated between a pair of adjacent spacer walls 135. In other embodiments, spacer walls 135 need not be between each row. And, in some displays, space walls 135 may not be present. A pixel row includes all of the pixels along one row line 230. Two or more pixels rows (and as much as 24–100 pixel rows), are generally located between each pair of adjacent spacer walls 135.

In color displays, each column of pixels has three column lines 250: (1) one for red; (2) a second for green; and (3) a third for blue. Likewise, each pixel column includes one of each phosphor stripes (red, green, blue), three stripes total. In a monochrome display, each column contains only one stripe. In the present embodiment, each of the column lines 250 is coupled to the gate electrode of each emitter structure of the associated column. Further, in the present embodiment, the column lines 250 for coupling to column driver circuits (not shown) and the row lines 230 are for coupling to row driver circuits (not shown).

In operation, the red, green and blue phosphor stripes are maintained at a high positive voltage relative to the voltage of the emitter-cathode 60/40. When one of the sets of electron-emission elements is suitably excited by adjusting the voltage of the corresponding row lines 230 and column lines 250, elements 40 in that set emit electrons which are accelerated toward a target portion 30 of the phosphors in the corresponding color. The excited phosphors then emit light. During a screen frame refresh cycle (performed at a rate of approximately 60 Hz in one embodiment), only one row is active at a time and the column lines are energized to illuminate the one row of pixels for the on-time period. This is performed sequentially in time, row by row, until all pixel rows have been illuminated to display the frame. The above FED configuration is described in more detail in the following United States Patents: U.S. Pat. No. 5,541,473 issued on Jul. 30, 1996 to Duboc, Jr. et al.; U.S. Pat. No. 5,559,389 issued on Sep. 24, 1996 to Spindt et al.; U.S. Pat. No. 5,564,959 issued on Oct. 15, 1996 to Spindt et al.; and U.S. Pat. No. 5,578,899 issued Nov. 26, 1996 to Haven et al., which are incorporated herein by reference.

Fed Conditioning Procedure According to One Embodiment of the Present Invention The present invention provides for a process of conditioning newly fabricated FEDs to remove contaminant species contained therein. The conditioning process is performed before the FED device is used in normal operations, and is typically performed during manufacturing. During the conditioning process of the present invention, contaminants contained in the vacuum tube of an FED are bombarded by a large amount of electrons. As a result of the bombardment, the contaminants will be knocked off and collected by a gas-trapping device (e.g., a getter). Because newly fabricated FEDs contain a large amount of contaminants, precautious steps must be taken to ensure that arcing does not occur during the conditioning process in accordance with the present invention. To this end, according to the present invention, the conditioning process includes the step of driving the anode to a predetermined high voltage and the step of enabling the emission cathode thereafter to ensure that the electrons are pulled to the anode. In furtherance of one embodiment of the present invention the emission current is slowly increased to the maximum value after the anode voltage has reached the predetermined high voltage.

Figure 3:
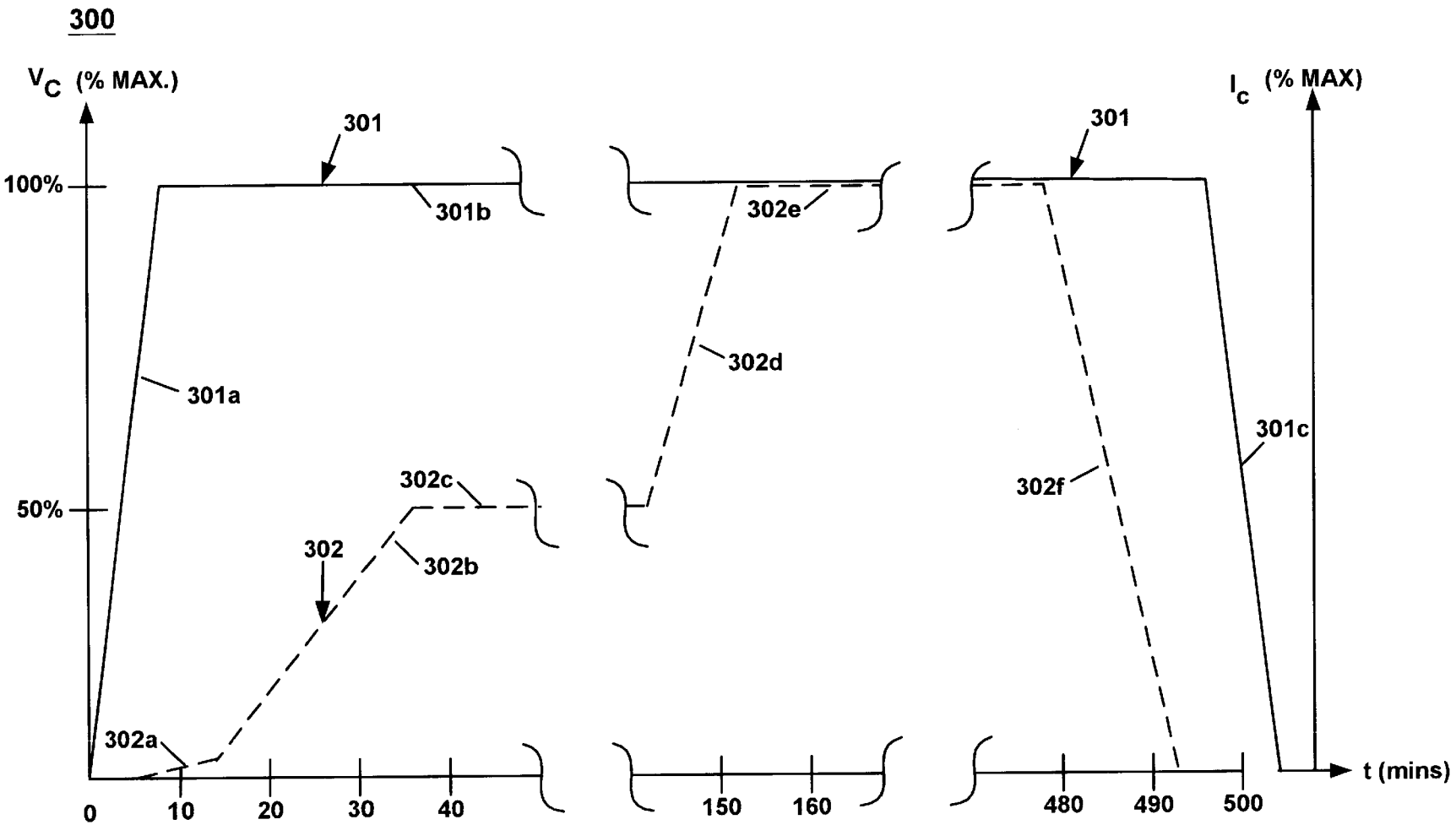
FIG. 3 illustrates a voltage and current application technique for turning-on an FED device according to one embodiment of the present invention.

FIG. 3 illustrates a plot 300 showing the changes in anode voltage level and emission current level of a particular FED during the conditioning process of the present embodiment. Plot 301 illustrates the changes in anode voltage ($V_C$), and plot 302 illustrates the changes in emission current ($I_C$). Particularly, $V_C$ is represented as a percentage of a maximum anode voltage provided by the driver electronics. For instance, a maximum anode voltage may be 3,000 volts. It should be noted that the maximum anode voltage may not be the normal operational voltage of the anode. For example, the normal operational voltage of the display screen may be 25% to 75% of the maximum anode voltage. $I_C$ is represented as a percentage of a maximum emission current provided by the driver circuits of the FED. Driver electronics and electronic equipment for providing high voltages and large currents to FEDs are well known in the art, and are therefore not discussed herein to avoid obscuring aspects of the present invention.

According to the present invention, plot 301 includes a voltage ramp segment 301*a*, a first level segment 301*b*, and a voltage drop segment 301*c*; and plot 302 includes a first current ramp segment 302*a*, a second current ramp segment 302*b*, a second level segment 302*c*, a third current ramp segment 302*d*, a third level segment 302*e*, and a current drop segment 302*f*. In the particular embodiment as shown, in the voltage ramp segment 301*a*, $V_C$ increases from 0% to 100% of the maximum anode voltage over a period of approximately 5 minutes. Significantly, $I_C$ remains at 0% as $V_C$ increases to ensure that the electrons are pulled towards the display screen (anode) instead of the gate electrodes.

After $V_C$ has reached 100% of the maximum anode voltage, $V_C$ is maintained at that voltage level for roughly 25 minutes. Contemporaneously, $I_C$ is slowly increased from 0% to 1% of the maximum emission current over approximately 10 minutes (first current ramp segment 302*a*). Thereafter, $I_C$ is slowly increased to 50% of the maximum emission current over approximately 20 minutes (second current ramp segment 302*b*). $I_C$ is then maintained at the 50% level for roughly 10 minutes (third level segment 302*c*). According to the present invention, $I_C$ is increased at a slow rate to avoid the formation of high ionic pressure zones formed by desorption of the electron emitters. Desorbed molecules may form small zones of high ionic pressure, which may increase the risk of arcing. Thus, by slowly increasing the emission current, the occurrence of arcing is significantly reduced.

According to FIG. 3, $I_C$ is then maintained at a constant level for approximately 10 minutes (third level segment 302*c*) for "soaking" to occur. Soaking refers to the process by which contaminant species are removed by gas-trapping devices. Gas-trapping devices, generally known as "getters," are used by the present invention at this stage of the conditioning process and are well known in the art.

In one embodiment, after the soaking period, $I_C$ is then subsequently increased to 100% of its maximum level (third current ramp 302*d*) and, thereafter, remained at that level for approximately 2 hours (fourth level segment 302*e*).

Contemporaneously, $V_C$ is maintained at its maximum level. Thereafter, $V_C$ and $I_C$ are then subsequently brought back to 0% of their respective maximum values. Significantly, as illustrated by segments 302*f* and 301*c* of FIG. 3, $I_C$ is turned off before $V_C$ is turned off. In this way, it is ensured that all emitted electrons are pulled towards the display screen (anode) and that gate-to-emitter currents are prevented.

During the conditioning process of the present invention, any knocked off or otherwise released contaminants are collected by gas-trapping devices, otherwise known as "getters." Getters, as discussed above, are well known in the art. In the particular embodiment as illustrated in FIG. 3, the total conditioning period is roughly six hours. After this conditioning period, most of the contaminants would have been knocked off and collected by the getters, and the newly fabricated FED screen would be ready for normal operation.

Some gas species, CH(4) for example, are not pumped by the getter. These species are pumped by the tube operation. Electrons break apart and ionized the gas molecules. The ions are accelerated by the electric field into the cathode and faceplate.

Figure 1:
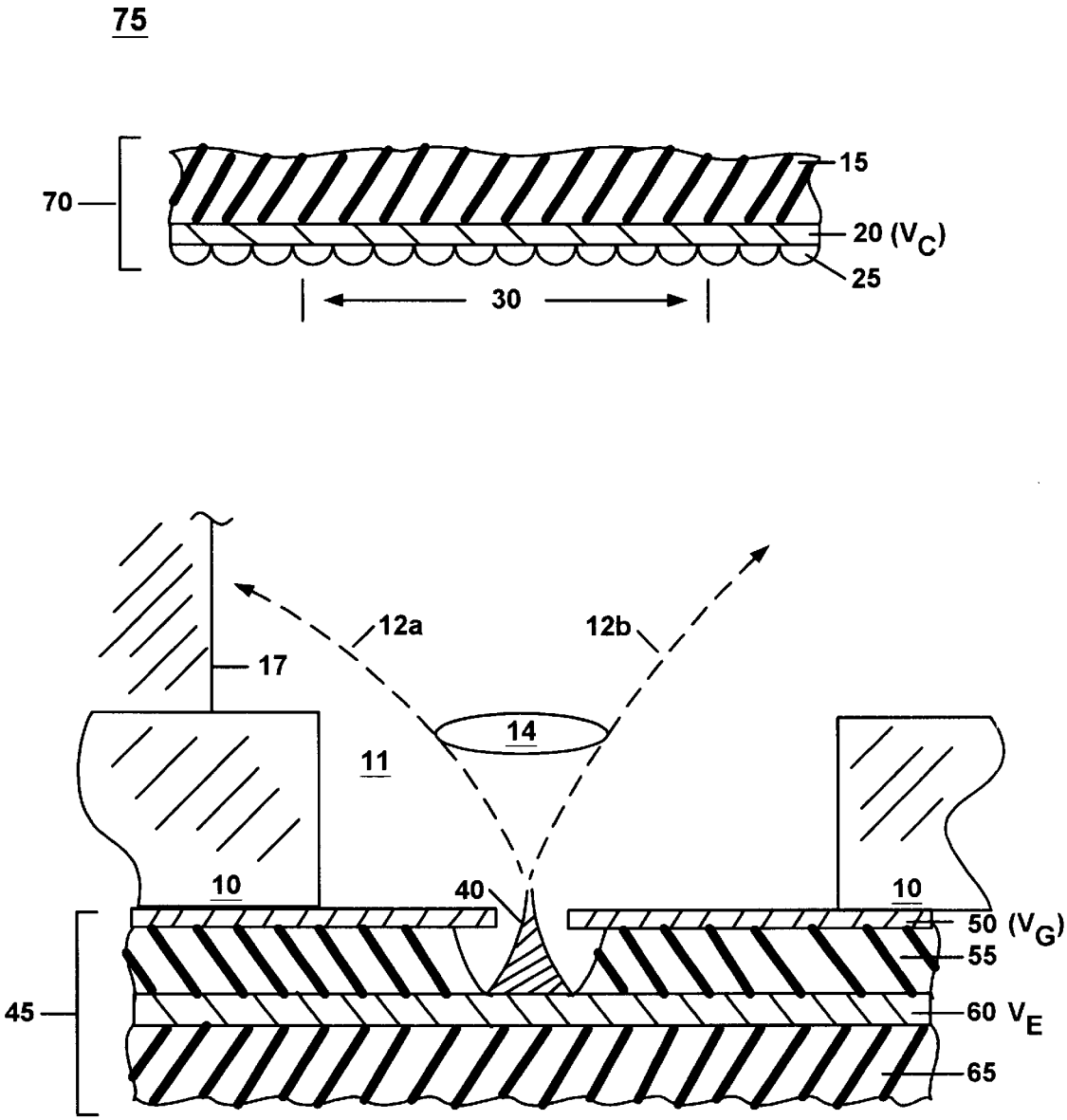
FIG. 1 is a cross section structural view of part of a flat panel FED screen that utilizes a gated field emitter with spacers and a focus waffle.
Figure 4:
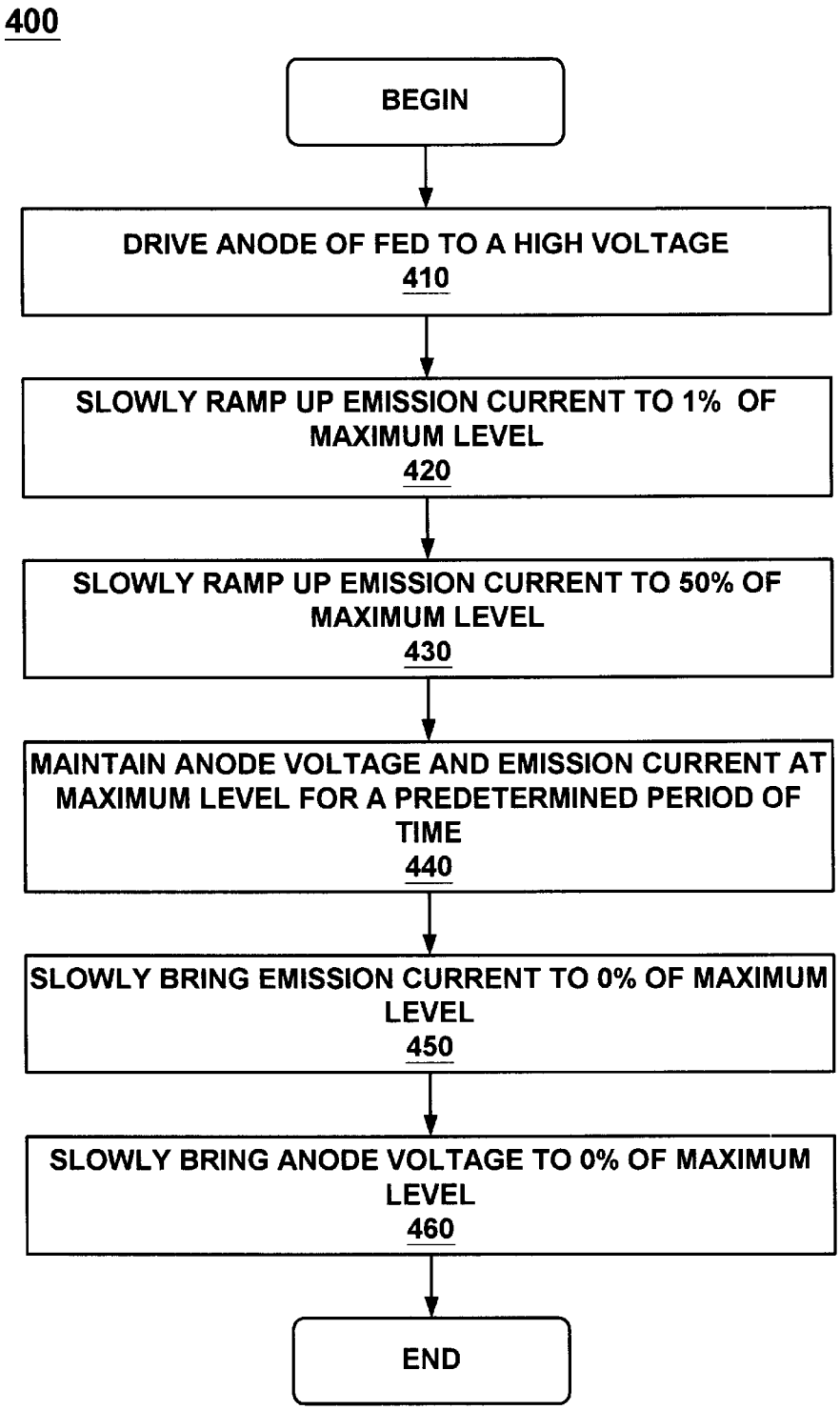
FIG. 4 illustrates a flow diagram of the steps of an FED conditioning process according to one embodiment of the present invention.

FIG. 4 is a flow diagram 400 illustrating steps of the FED conditioning process according to the present invention. To facilitate the discussion of the present invention, flow diagram 400 is described in conjunction with exemplary FED structure 75 illustrated in FIG. 1. With reference now to FIGS. 1 and 4, at step 410, the anode 20 of the FED is driven to a high voltage. It should be noted that, at step 410, the emission current ($I_C$) is maintained at 0% of the maximum level, and is therefore off. In one embodiment of the present invention, the voltage of the gate electrode 50 and the emitter-cathode 60/40 are maintained at ground. The anode voltage is driven to a high voltage while maintaining an emission current at 0% to ensure that the electrons, once emitted, are pulled to the anode 20 rather than the gate electrode 50.

At step 420 of FIG. 4, the emission current $I_C$ is slowly increased to 1% of a maximum emission current provided by driver electronics of the FED. In one particular embodiment of the present invention, step 420 takes roughly 5 minutes to accomplish. The slow ramp up ensures that localized zones of high ionic pressure will not be formed by desorption of the electron emitters. Further, in the present embodiment, the emission current $I_C$ is proportional to the gate-to-emitter voltage ($V_{GE}$) as predicted by the Fowler-Nordheim theory. Thus, in the present embodiment, the emission current $I_C$ may be controlled by adjusting the gate-to-emitter voltage $V_{GE}$.

At step 430 of FIG. 4, the emission current $I_C$ is ramped up to approximately 50% of the maximum emission current provided by driver electronics of the FED. In one embodiment, step 430 takes roughly 10 minutes to accomplish. As in step 420, the slow ramp up allows ample time for desorbed molecules to diffuse away, and ensures that localized zones of high ionic pressure are not formed.

At step 440 of FIG. 4, emission current $I_C$ and anode voltage $V_C$ are maintained at 100% of their respective maximum values such that a large amount of electrons will be emitted. The emitted electrons will bombard and knock off most loose contaminants unremoved by previous fabricating processes. The knocked off contaminants are subsequently trapped by ion-trapping devices such as the getters. As discussed above, getters are well known in the art, and are therefore not described herein to avoid obscuring aspects of the invention.

At step 450, the emission current is brought to 0% of the maximum value. Subsequently, at step 460, the anode voltage is brought to 0% of its maximum value. It is important to note that emission current is turned-off prior to turning-off the anode voltage such that all emitted electrons will be attracted to the anode. Thereafter, the conditioning process 400 ends.

Figure 5:
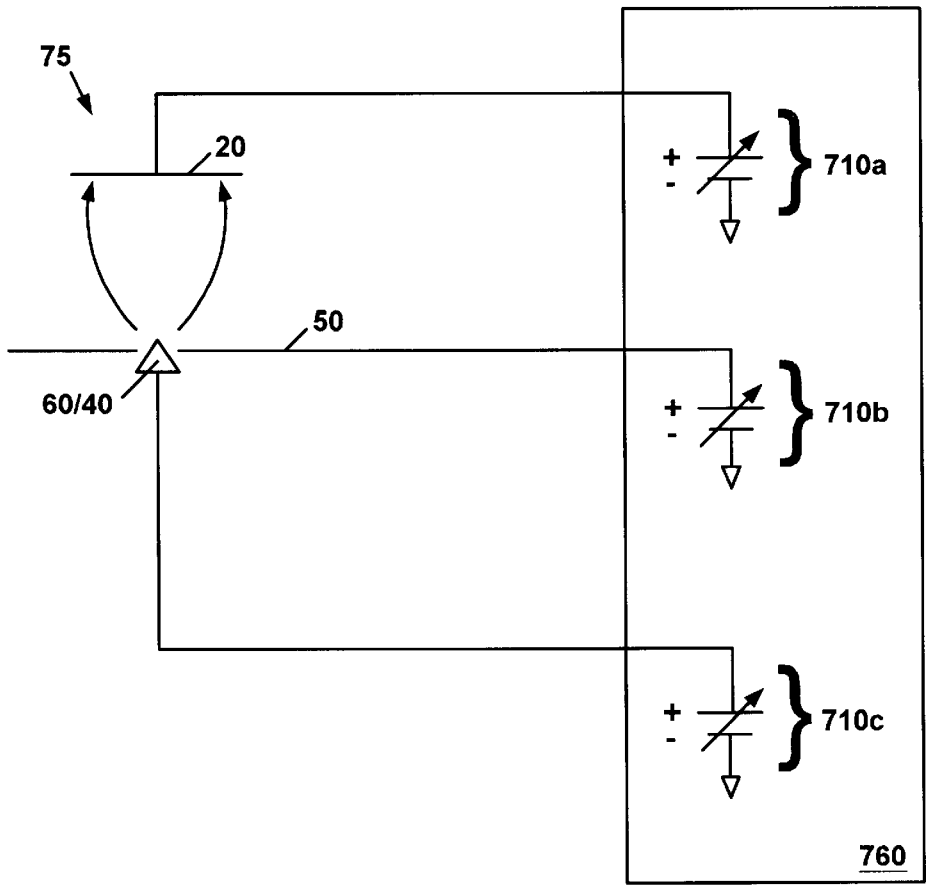
FIG. 5 illustrates a block diagram of a system for conditioning an FED according to one embodiment of the present invention.

FIG. 5 is a block diagram 700 illustrating an apparatus for controlling the conditioning process according to one embodiment of the present invention. A simplified diagram of the FED 75 of FIG. 1 is also illustrated. With reference to FIG. 5, the apparatus includes a controller circuit 710 configured for coupling to FED 75. Particularly, controller circuit 710 includes a first voltage control circuit 710*a* for providing an anode voltage to anode 20 of FED 75. Controller circuit 710 further includes a second voltage control circuit 710*b* for providing a gate voltage to gate electrode 50, and third voltage control circuit 710*c* for providing a emitter voltage to emitter cathode 60/40. It should be appreciated that the controller circuit 710 is exemplary, and that many different implementations of the controller circuit 710 may also be used.

In operation, the voltage control circuits 710*a–c* provide various voltages to the anode 20, gate electrode 50 and emitter electrode 60/40 of the FED 75 to provide for different voltages and emission current during the conditioning process of the present invention. In one embodiment of the present invention, the controller circuit 710 is a stand alone electronic equipment specially made for the present conditioning process to provide very high voltages. However, it should be appreciated that controller circuit 710 may also be implemented within an FED to control the anode voltage and emission currents during turn-on and turn-off of the FED.

Fed Turn-on and Turn-off Procedures of the Present Invention

The present invention also provides for a method of operating a field emission display to minimize the risk of arcing during power-on and power-off of the FED unit. Particularly, according to one embodiment of the present invention, the method of operating an FED includes the steps of: turning on the anodic display screen of the FED, and, thereafter, turning on the emission cathodes. According to another embodiment of the present invention, the method of operating an FED to minimize the risk of arcing includes the steps of: turning off the emission cathodes, and thereafter, turning-off the anodic display screen. According to the present invention, the occurrence of arcing is substantially reduced by following the aforementioned steps.

Figure 6:
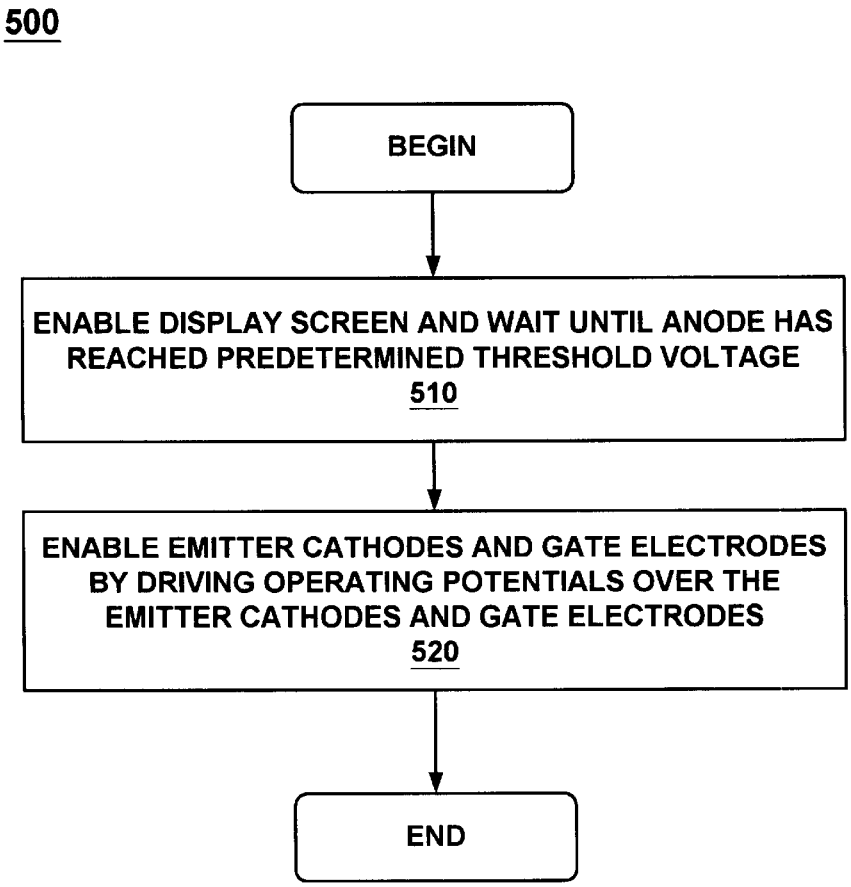
FIG. 6 illustrates a flow diagram of the steps of an FED turn-on procedure according to another embodiment of the present invention.

FIG. 6 illustrates a flow diagram 500 of steps within an FED turn-on procedure according to another embodiment of the present invention. In order to facilitate the discussion of the present invention, flow diagram 500 is described in conjunction with exemplary FED 75 of FIG. 1. With reference now to FIGS. 1 and 6, at step 510, when the FED 75 is switched on, the anode 20 is enabled. In the present embodiment, the anode is enabled by the application of a predetermined threshold voltage (e.g. 300 V). Further, in the present invention, the anode may be enabled by switching on a power supply circuit (not shown) that supplies power to the anode 20. Power supplies for FEDs are well known in the art, and any number of well know power supply devices can be used with the present invention.

At step 520, after the anode 20 of the FED 75 is enabled, and after the anode has reached the predetermined threshold voltage, the emitter cathode 60/40 and the gate electrode 50 of the FED 75 are then enabled. In the present invention, the emitter cathode 60/40 of the FED 75 is enabled a predetermined period after the anode 20 has been enabled to direct the electrons towards the anode 20 and to prevent the electrons from striking the gate electrode 50. In one embodiment, the emitter cathode 60/40 and the gate electrode 50 may be enabled by switching on the row and column driver circuits (not shown) of the FED.

Figure 7:
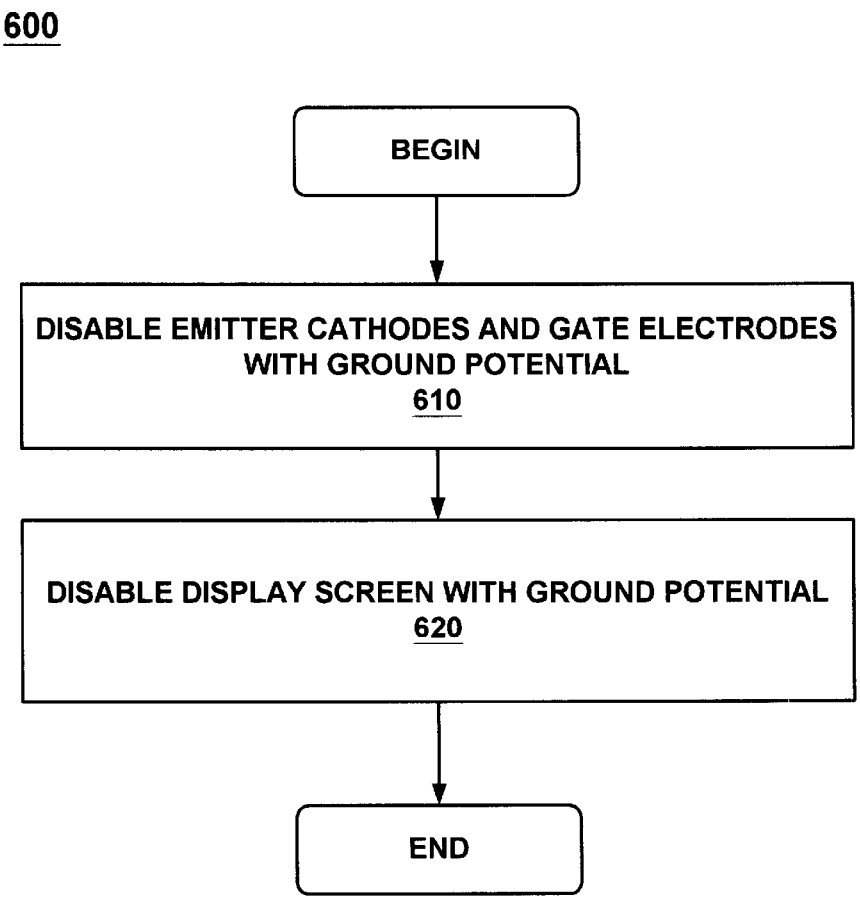
FIG. 7 illustrates a flow diagram of the steps of an FED turn-off procedure according to another embodiment of the present invention.

FIG. 7 is a flow diagram 600 illustrating steps of an FED turn-off procedure according to another embodiment of the present invention. In the following, flow diagram 600 is discussed in conjunction with exemplary FED 75 of FIG. 1. With reference now to FIG. 1 and 7, at step 610, when the FED is switched off, the emitter cathode 60/40 and the gate electrode 50 of the FED 75 are disabled. Contemporaneously, the anode 20 remains at a high voltage. Further, in one embodiment, the emitter cathode 60/40 and gate electrode 50 are disabled by setting the row voltages and column voltages respectively provided by row drivers and column drivers (not shown) to a ground potential.

At step 620, after the emitter cathode 60/40 and the gate electrode 50 are disabled, the anode 20 of the FED is disabled. According to the present invention, step 620 is performed after step 610 in order to ensure that all electrons emitted from emission cathodes will be attracted to the anodic display screen. In one embodiment, the anode 20 is disabled by switching off the power supply circuit (not shown) that supplies power to the anode 20. In this way, the occurrence of arcing in FEDs is minimized.

Fed Conditioning Process According to Another Embodiment of the Invention

Figure 8:
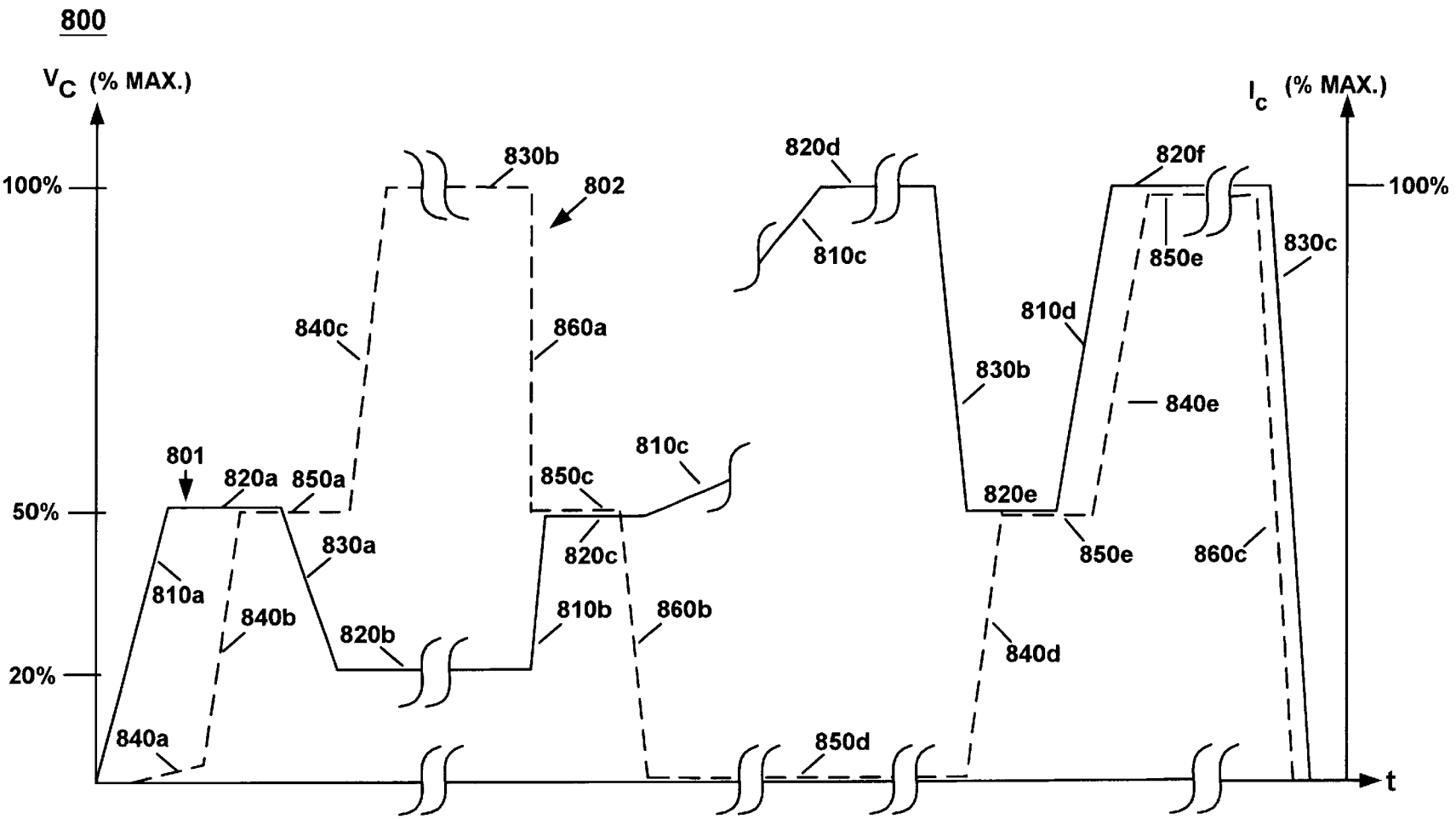
FIG. 8 illustrates a voltage and current application technique for turning-on an FED device according to another embodiment of the present invention.

FIG. 8 is a plot 800 illustrating a voltage and current application technique for conditioning a particular FED device according to another embodiment of the present invention. Plot 801 illustrates the changes in anode voltage ($V_C$), and plot 802 illustrates the changes in emission current ($I_C$). Particularly, $V_C$ is represented as a percentage of a maximum anode voltage provided by the driver electronics. $I_C$ is represented as a percentage of a maximum emission current provided by the driver circuits of the FED.

According to the present invention, plot 801 includes voltage ramp segments 810*a–d*, constant voltage segments 820*a–f*, voltage drop segments 830*a–c*; and plot 302 includes current ramp segments 840*a–e*, constant current segments 850*a–e*, and current drop segments 860*a–c*. In the particular embodiment as shown, in the voltage ramp segment 810*a*, $V_C$ increases from 0% to 50% of the maximum anode voltage over a period of approximately 10 minutes. Significantly, $I_C$ remains at 0% as $V_C$ increases to ensure that the electrons are pulled towards the display screen (anode) instead of the gate electrodes.

After $V_C$ has reached 50% of the maximum anode voltage, $V_C$ is maintained at that voltage level for roughly 30 minutes (constant voltage segment 820*a*). Contemporaneously, $I_C$ is slowly increased from 0% to 1% of the maximum emission current over approximately 10 minutes (current ramp segment 840*a*). Thereafter, $I_C$ is slowly increased to 50% of the maximum emission current over approximately 10 minutes (current ramp segment 840*b*). $I_C$ is then maintained at the 50% level for roughly 10 minutes (constant current segment 850*a*). According to the present invention, $I_C$ is increased at a slow rate to avoid the formation of high pressure zones formed by desorption of the electron emitters. Desorbed molecules may form small zones of high pressure, which may increase the risk of arcing. By slowly increasing the emission current, ample time is allowed for the desorbed molecules may diffuse to gas-trapping devices (e.g., getters). In this way, occurrence of arcing is significantly reduced.

According to FIG. 8, $V_C$ is reduced from 50% to 20% level (voltage drop segment 830*a*) and is maintained at the 20% level for roughly 30 minutes (constant voltage segment 820*b*). After $V_C$ has reached the 20% level, $I_C$ is slowly ramped up to the 100% level (current ramp segment 840*c*). It should be noted that the 20% level is selected such that the anode voltage is close to a minimum threshold level for the anode of the FED to attract the emitted electrons. $I_C$ is then maintained at a constant level for approximately 20 minutes (constant current segment 820*b*) for "soaking" occur.

In the present embodiment, $I_C$ is then subsequently decreased to 50% of its maximum level (current drop segment 860*a*) and, thereafter, remained at that level for approximately 20 minutes (constant current segment 850*c*). After $I_C$ has reached the 50% level, $V_C$ is increased to the 50% level (voltage ramp segment 810*b*) and is maintained at that level for 20 minutes (constant current level 820*c*). Thereafter, $I_C$ is turned-off to 0% of its maximum value (current drop segment 860*b*).

After $I_C$ is turned off, $V_C$ is slowly ramped up to 100% of its maximum level over a period of approximately 2.5 hours (voltage ramp segment 810*c*), and is maintained at the maximum level for approximately 1 hour (constant voltage segment 820*d*). Thereafter, $V_C$ is decreased to the 50% level (voltage drop segment 830*b*), and is maintained at that level for approximately 20 minutes (constant voltage segment 820*e*). $I_C$ is slowly increased from 0% to the 50% level (current ramp 840*d*) when $V_C$ is at 50% level. $V_C$ and $I_C$ are then subsequently driven to 100% of their respective maximum values (voltage ramp segment 810*d* and current ramp segment 840*e*), and are maintained at those levels for approximately 1.5 hours (constant voltage segment 820*f* and constant current segment 850*e*). Thereafter, $V_C$ and $I_C$ are brought back to 0% (voltage drop segment 830*c* and current drop segment 860*c*).

Significantly, as illustrated by segments 810*d* and 840*e* of FIG. 8, $I_C$ is driven to the maximum value after $V_C$ is driven to the maximum value, and $I_C$ is turned off before $V_C$ is turned off. In this way, it is ensured that all emitted electrons are pulled towards the display screen (anode) and that gate-to-emitter currents are prevented.

Figure 9:
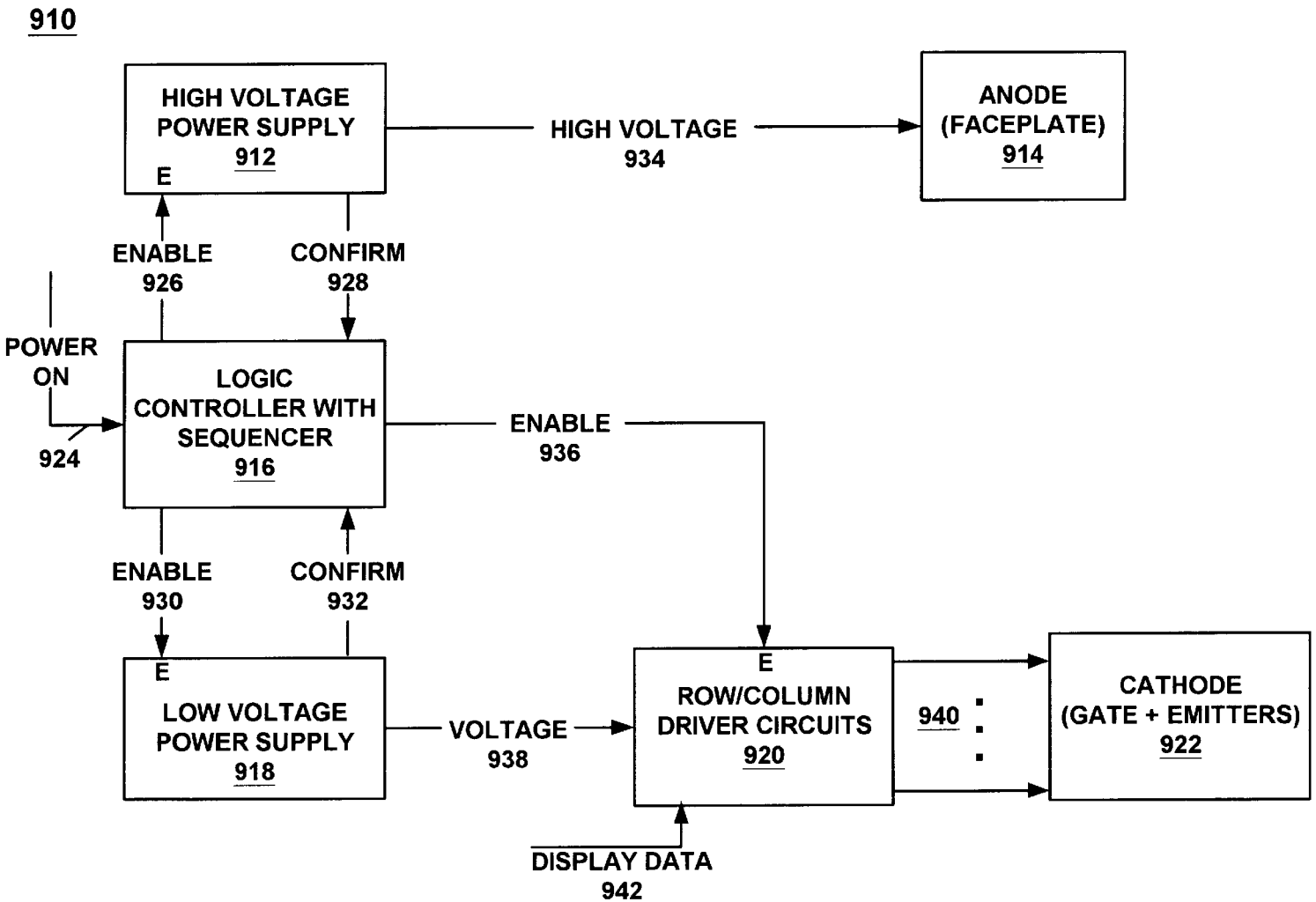
FIG. 9 illustrates a logical block diagram of a circuit in accordance with an embodiment of the present invention for use at power-on and power-off of the FED screen during normal operational use of the screen.

Operational Use Power-on and Power-off Circuit of an Embodiment of the Present Invention FIG. 9 illustrates a logical block diagram of a power-on/power-off circuit 910 in accordance with an embodiment of the present invention. Circuit 910 is used to power-on and to power-off the FED screen during the normal operational use of the screen. That is, circuit 910 is used on each time the FED screen is turned on and turned off. Circuit 910 is enforces a power on and power off procedure that is directed to reducing degradation of the emitter electrode 60 (FIG. 1) and gate electrode 50 (FIG. 1) during power-on and power-off of the FED screen.

In particular, circuit 910 in accordance with this embodiment of the present invention is used to insure that the anode electrode 20 (FIG. 1) is at a high voltage level before the emitter electrode 60 is energized. In this condition, electrons emitted from the emitter electrode 60 will be pulled toward the anode electrode 20 thereby avoiding any contact/collision with the gate electrode 50. Electron emission from the emitter to the gate electrode is responsible for materially degrading the gate electrode. Ions dislodged from the gate electrode as a result of this electron emission can also fall into the emitter electrode thereby degrading the emitter electrode as well.

FIG. 9 illustrates the components of circuit 910. A logic controller 916 is provided that contains a sequencer. The sequencer can be realized by an internal state machine. In response to a power-on signal from line 924, the logic controller 916 generates a first enable signal over line 926 which is coupled to a high voltage power supply 912. The power-on signal over line 924 can be responsive to an on/off switch. In response to a confirmation signal 928, the logic controller 916 also generates a second enable signal over line 930 which is coupled to a low voltage power supply 918. When not enabled by lines 926 and 930, the high and low voltage power supplies are disabled, e.g., they do not output any voltage level. The high voltage power supply is coupled, via power supply line 934, to the anode 20 (FIG. 1) of the faceplate, which in FIG. 9 is designated as 914. The low voltage power supply 918 is coupled, via power supply lines 938, to row and column driver circuits 920 as a their supply voltage. These row and column driver circuits are coupled to the gate electrodes and the emitter electrodes 922 that make up the display matrix (e.g., the rows and columns of pixels) within the FED device. Analog driving voltages are applied over lines 940 which are coupled to the gate and emitter electrodes, which in combination are called the "cathode."

The high voltage power supply 912 has an output 934 that can be enabled and disabled by line 926. The high voltage power supply 912 provides a logic level signal that indicates the presence or absence of high voltage output from the supply. This is called the confirmation signal which is generated over line 928 and the confirmation signal is generated upon the operational voltage of the high voltage power supply 912 being achieved at its output. The confirmation signal line 928 is coupled back to the control logic 916. In one embodiment, the voltage level of the high voltage power supply 912 is between 5,000 and 10,000 volts. Removal of the enable signal 926 causes the high voltage power supply 912 to enter a standby state (e.g., zero output on line 934 and minimum input current mode).

The low voltage power supply 918 has an output 938 that can be enabled and disabled by line 930. The Low voltage power supply 918 optionally provides a confirmation logic level signal that indicates the presence or absence of low voltage output from the supply. This optional confirmation signal is generated over line 932 and is generated upon the operational voltage of the low voltage power supply 918 being achieved at its output 938. This optional confirmation signal line 932 is coupled back to the control logic 916. In one embodiment, the voltage level of the low voltage power supply 918 is sufficient to provide the necessary potentials for the emitters and gates, e.g., between −20 and +15 volts. Removal of the enable signal 930 causes the low voltage power supply 918 to enter a standby state (e.g., zero output on line 938 and minimum input current mode).

The control logic 916 of FIG. 9 also generates a third enable signal over line 936 which enables row and column driver circuits 920. The driving circuits 920 convert video image information (from line 942) into electrical potentials 940 specific to each emitter group. The outputs of the driver circuitry 920 can be enabled and disabled via line 936. Removal of the enable signal 936 causes the driver circuitry 920 to enter a standby state (e.g., zero output on lines 940 and minimum input current mode). The driver circuits 920 are coupled to receive a voltage supply from low voltage power supply 918.

As shown in FIG. 9, in order to enable the gate and emitter electrodes, both enable signals 930 and 936 are required. In order to enable the anode electrode, enable signal 926 is required.

Figure 10:
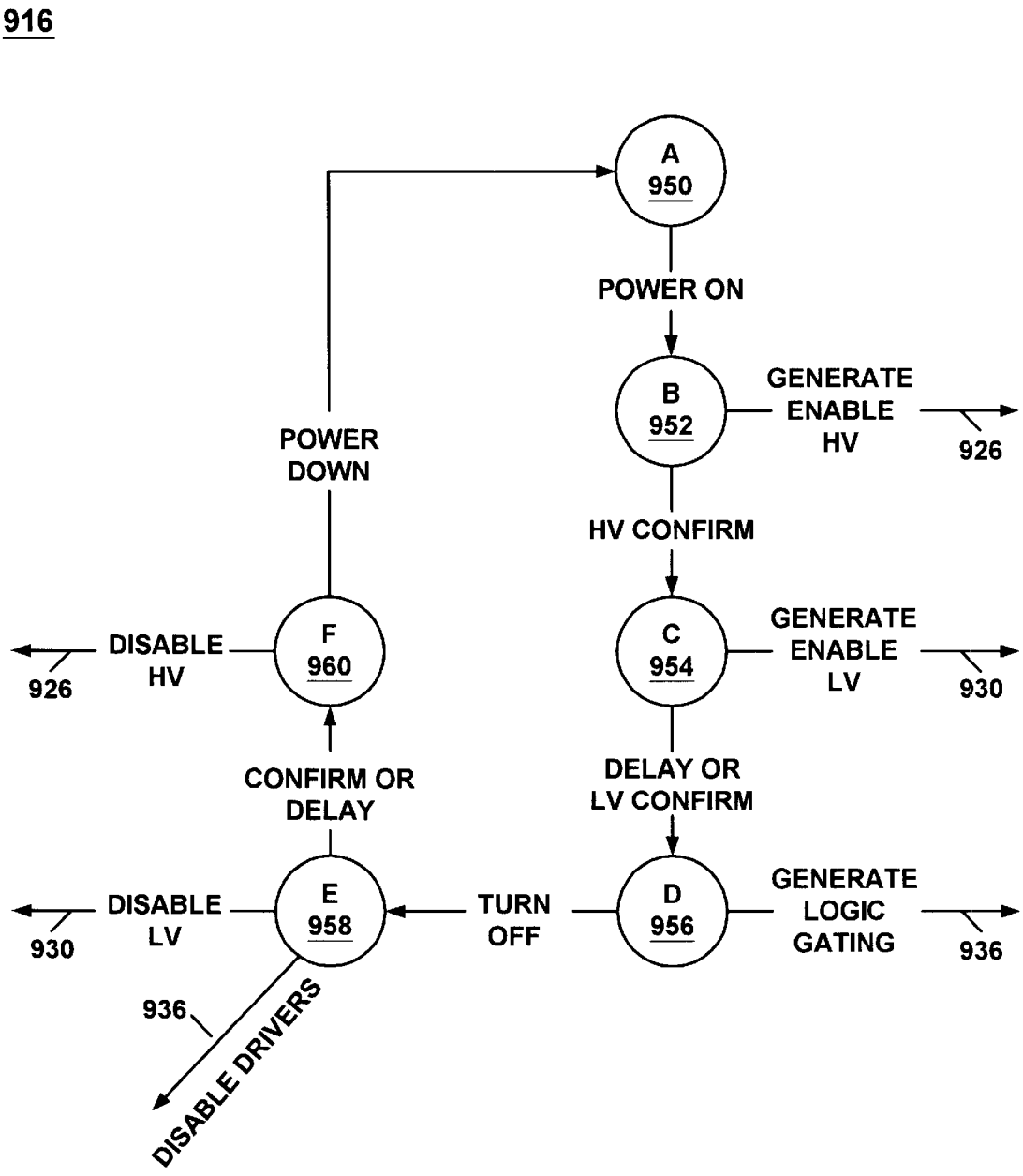
FIG. 10 illustrates a state diagram outlining the control steps performed by the control logic circuit of the circuit of FIG. 9 in accordance with an embodiment of the present invention.

FIG. 10 illustrates a state diagram outlining the control steps performed by the control logic circuit of the circuit of FIG. 9 in accordance with an embodiment of the present invention. This sequence guarantees that the FED will not emit electrons unless there is an anode potential present. This prevents the condition of electron emission without anode potential that can result in emitter and gate degradation.

More specifically, FIG. 10 illustrates the states of an exemplary state machine implementation of the control logic 916. In the initial state 950, power is off and all power supplies and driver circuits of FIG. 9 are disabled. In response to a power on signal, state 952 is entered where the enable line 926 is activated thereby enabling the high voltage power supply 912. Upon the high voltage power supply 912 establishing its operational voltage at its output, a confirmation signal is supplied to the control logic 916 thereby causing state 954 to be entered. At state 954, the control logic 916 generates an enable signal over line 930 to enable the low voltage power supply 918 which had been disabled.

In response to the passage of a predetermined amount of time (delay period), or in response to a confirmation signal over optional line 932, state 956 is entered. At state 956, the control logic 916 then generates an enable signal over line 936 to enable the driver circuits 920. At state 956, the FED screen is fully powered up and enabled. Video information can then be presented onto the FED screen. It is appreciated that by powering-on the gate and emitter electrodes only after the anode has fully powered on, the present invention provides a circuit 910 that substantially reduces emitter and gate electrode degradation. In other words, electron emission from the emitter to the gate electrode is substantially reduces and/or eliminated by circuit 910.

FIG. 10 also illustrates the power-off states of the control logic 916. From state 956, state 958 is entered in response to a power-off signal over line 924, e.g., in response to the on/off switch. At state 958, the driver circuits 920 are disabled via line 936 and also the low voltage power supply 918 is disabled via line 930. In response to the passage of a predetermined amount of time (delay period), or in response to a confirmation signal over optional line 932, state 960 is then entered. At state 960, the high voltage power supply 912 is disabled via line 926. State 950 is then entered.

Alternative Ways to Detect Faceplate Voltage

The following describes alternative ways in which to detect the presence of voltage on the faceplate, in addition to the methods and systems described above. Detection of the high voltage controls the interlock of the row and column bias voltages. This prevents electrons from being emitted from the cathode when the faceplate high voltage is not present as they can hit the cathode and walls causing outgassing and emission non-uniformities. Below are described methods for detecting the high voltage on the faceplate in addition to using a signal generated by the high voltage power supply.

In one embodiment, the application of the high voltage supply can be detected by monitoring and detecting the current into the focus waffle. The focus waffle is described in more detail in U.S. Pat. No. 5,528,103, assigned to the assignee of the present invention and issued on June 18, 1996 which is incorporated herein by reference. In this embodiment, the system will suspend until the current from the focus waffle stabilizes. The final current value depends on the ambient temperature due to wall TCR. When the current stabilizes, then the rows and columns are enabled and the cathode is enabled.

In another embodiment, the voltage rise at the faceplate is capacitively detected through either the focus waffle or a conducting layer (such as an antistatic cover) over the faceplate. It is appreciated that the signal from the layer over the faceplate will be larger than from the focus waffle because the capacitance is higher. When the voltage stabilizes or reaches it high voltage point, then the rows and columns are enabled and the cathode is enabled.

In another embodiment, the electrostatic force to the faceplate is detected using a micromechanical (MEMS) force detector located at some out of the way corner of the faceplate. When the force reaches a predetermined level that corresponds to the high voltage level, then the rows and columns are enabled and the cathode is enabled.

In another embodiment, a trigger or "sweet" spot (pixel) is located in a corner of the cathode which is activated (preferably in a pulsed mode) whenever the power is on, e.g., the high voltage. Then, light output is detected from a small phosphor patch over the trigger spot. Electrons from this trigger spot will cause some cathode outgassing when the faceplate high voltage was not present, but much less than running the entire cathode. When the trigger spot illuminates, then the rows and columns are enabled and the cathode is enabled. Using this same technology, an alternating current signal can be detected at the faceplate caused by pulsing the additional sweet spot. The current signal indicates that electronic are hitting the faceplate so some high voltage must be present. The current signal then triggers that the rows and columns are enabled and the cathode is enabled. With respect to this embodiment, a separate connection to the anode section can be used and which is connected to the rest of the anode and power supply through a resistor so the current into the anode section can be measured separately.

Cathode Burn-in Processes of the Present Invention that Avoid Display Non-uniformities These embodiments of the present invention are directed to methods of performing cathode conditioning and reconditioning in ways that avoid display non-uniformities in and around the locations of the spacer walls. As discussed above, the process of cathode burn-in ("cathode conditioning") performs at least two important functions. The first is that it is useful to forward bias the emitters 40 and allow inevitable "blow-outs" (e.g., shorts) to occur under low anode voltage conditions where they are much less likely to cause damaging faceplate-cathode arcs described above. The second function performed by cathode burn-in techniques is that they perform an important out-gassing function by cracking and pumping non-getterable gases with emitted electrons. For instance, cathode burn-in techniques ionize gasses thereby making them more reactive and therefore more likely to be captured by the getter. Further, by ionizing the gases, they are driven into the faceplate and are thereby pumped. Typically, the tubes begin cathode burn-in with a high pressure ($10^{-4}$ Torr) of mostly methane gas which is mostly pumped by the end of cathode burn-in.

Figure 11:
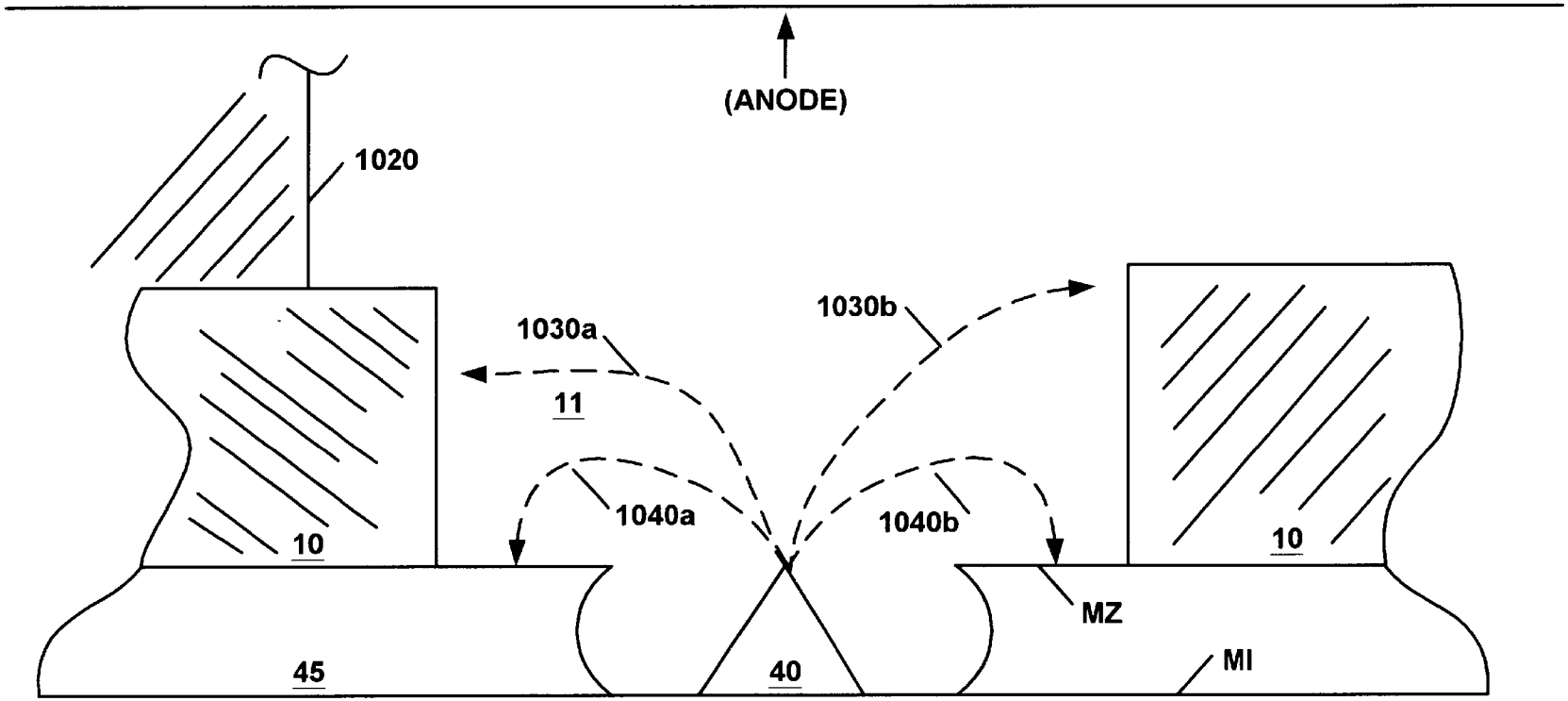
FIG. 11 illustrates a cross sectional diagram of a FED screen illustrating an electron emitter, cathode, focus waffle and spacers and electron pathways traversed during cathode burn-in procedures in accordance with embodiments of the present invention.

FIG. 11 illustrates a simplified cross sectional diagram of a FED screen. In this diagram, the electron emitter 40 is shown coupled to a gate structure. More specifically, the backplate structure 45 commonly consists of an electrically insulating backplate, an emitter (or cathode) electrode, an electrically insulating layer, a patterned gate electrode, and a conical electron-emissive element 40 situated in an aperture through insulating layer (as described with respect to FIG. 2A). The gate structure is composed of two metal layers, M1 and M2 as shown.

Importantly, a focus waffle structure 10 is used in this embodiment to provide electron alignment. Also used in this embodiment are spacer walls 1020 to help maintain the vacuum in the tube. In one implementation, the spacer walls 1020 are placed about one every 20–30 pixel rows across the FED screen but could be disposed in any fashion. The use and structure of spacer walls are described in more detail in the following U.S. Pat. Nos. 6,153,986; 6,107,731; 6,051,937; 6,049,165; 6,002,198; 5,859,502; 5,675,212; 5,650,690; and 5,649,847, which are all assigned to the assignee of the present invention and also all hereby incorporated herein by reference. In the diagram of FIG. 11, the anode is positioned toward the top. In this configuration, the spacer walls 1020 are disposed between the focus waffle structure 10 and the anode electrode.

In accordance with the cathode conditioning processes of the present invention, various states and conditions are imposed on the FED device that restrict electron flow out of the focus well 11 of the focus waffle structure 10 during cathode burn-in. By doing this, electrons are prevented from striking the spacer walls during cathode burn-in.

In one embodiment, the aspect ratio of the focus well 11, as expressed width to height is approximately 2:1. In one embodiment, the focus well 11 is approximately 80 micrometers width by 40 micrometers in height, but could be of any dimension.

Exemplary electron paths 1030*a–b* and 1040*a–b* are shown for electrons emitted from emitter 40 during the cathode conditioning processes of the present invention. The substantial majority of emitted electrons from emitter 40 follow these or similar paths during cathode conditioning of the present invention, and do not exit the focus well 11. Therefore, during cathode conditioning of the present invention, very few, if any, electrons reach the spacer walls 1020. Any electrons that may, if any at all, reach the spacer walls 1020 would only impact the base of the walls, e.g., the portion of the wall near the focus waffle structure 10 and would interact with only an insubstantial portion of the wall during the cathode conditioning processes of the present invention. Because the emitted electrons do not reach the spacer walls 1020 during cathode conditioning, in accordance with the processes of the present invention, display non-uniformities near the spacer walls are eliminated.

Figure 12:
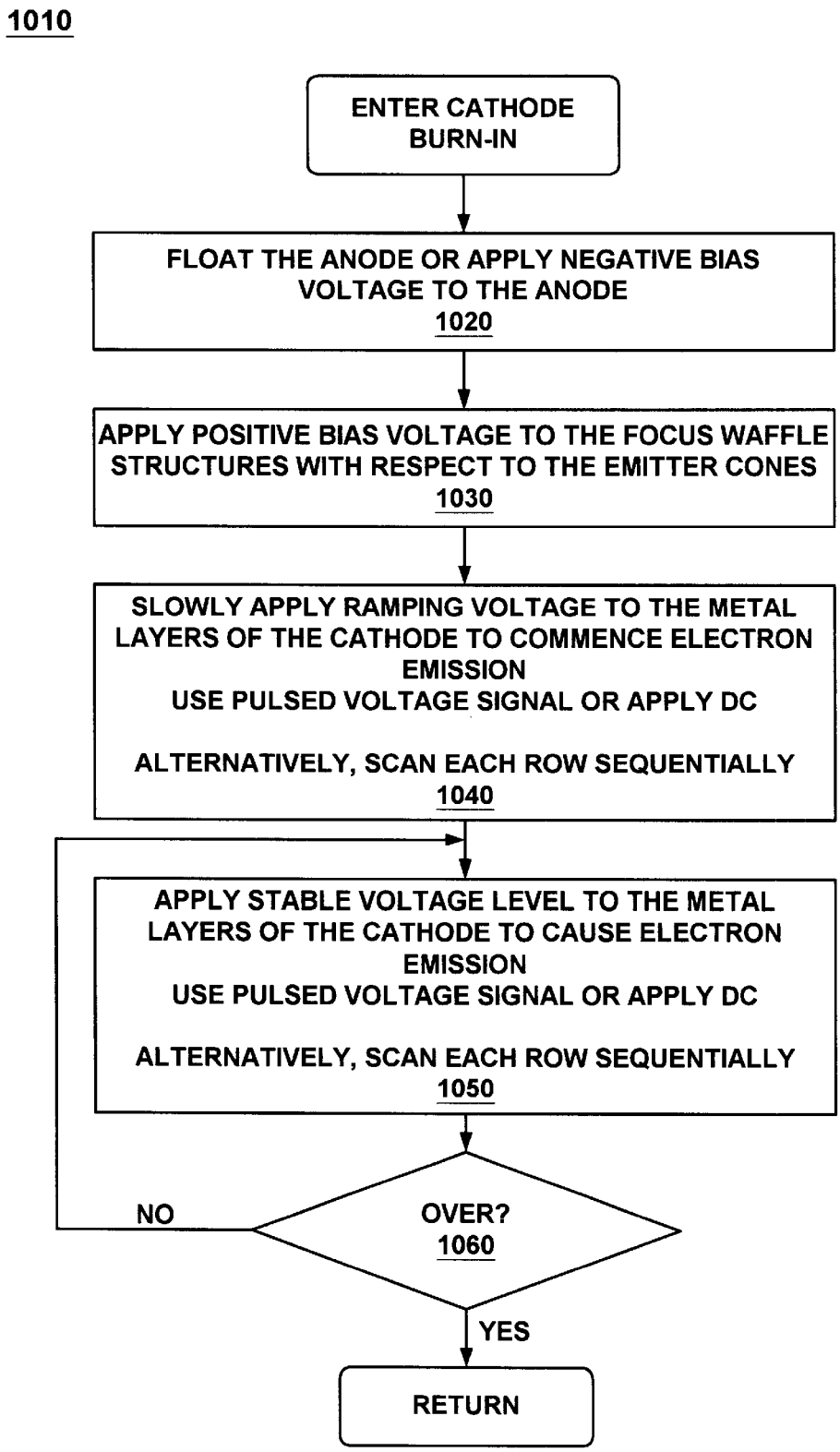
FIG. 12 is a flow diagram of steps performed by a first embodiment of the present invention for performing cathode burn-in conditioning that avoid display non-uniformities near and around the spacer walls.
Figure 15:
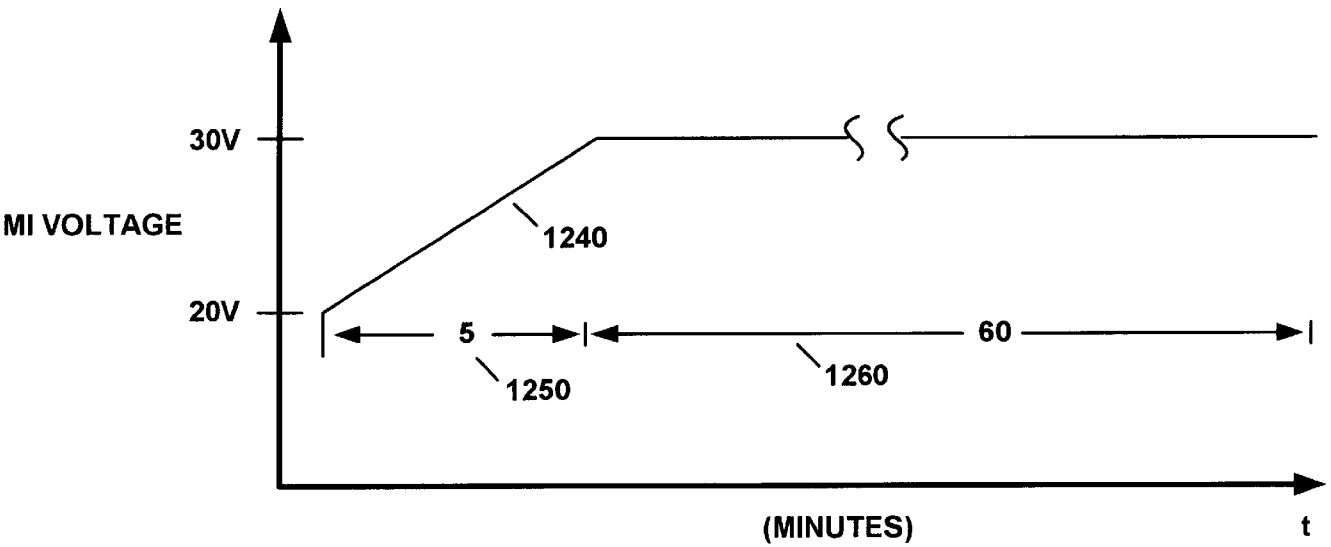
FIG. 15 illustrates a timing diagram of a voltage signal applied to a metal layer of the gate during cathode conditioning in accordance with embodiments of the present invention.

FIG. 12 illustrates a cathode conditioning process 1010 in accordance with a first embodiment of the present invention. Refer to FIG. 12, FIG. 11 and FIG. 15. According to this embodiment, during cathode burn-in, electrons are directed toward the focus waffle structure 10, e.g., paths 1030*a–b*, and are not allowed to exit the focus well 11. In this way, electrons emitted from emitter 40 do not reach the spacer walls 1020 during cathode conditioning.

According to process 1010, at step 1020 the anode electrode (e.g., faceplate) is either allowed to float or a negative bias is applied to it. Either condition may be done. In one implementation, the anode electrode may be negatively biased with respect to the emitter by approximately 100–500 volts. At step 1030, a positive bias voltage is applied to the focus waffle structure 10 with respect to the emitter. This positive bias voltage, in one implementation, may be between approximately 40–100 volts. It is appreciated that steps 1020 and 1030 may be performed in any order or may occur simultaneously.

At steps 1040 and 1050, the emitters are biased (e.g., energized) so that electrons are emitted from the emitter in accordance with cathode burn-in. During the initial cathode conditioning process, these steps may be lengthy, e.g., about 1 hour in duration.

At step 1040 of FIG. 12, a positive bias voltage is applied across the metal layers M1 and M2 of the gate such that the emitter 40 emits electrons. In other words, M1 and M2 are biased under the usual operating conditions of the tube so that electrons are emitted from the emitter. Under these conditions, electrons are energetically forbidden from hitting the anode or the spacer walls 1020, except for a small insubstantial region near the focus waffle structure 10. In one implementation, at step 1040, the positive bias voltage is ramped slowly from a first predetermined value (e.g., 20 volts) to a second predetermined value (e.g., 30), as shown in the timing diagram 1230 of FIG. 15 as region 1250. This may occur over a period of 5 minutes, in one example. In this example, the bias voltage 1240 is applied to metal layer M1 and metal layer M2 is at reference.

It is appreciated that in accordance with embodiments of the present invention, these predetermined values, or levels, of bias voltage discussed above may be measured by measuring the emission current collected from the focus waffle rather than the bias voltage across the tip to gate.

Voltage ramping at step 1040 eases the cathode conditioning process by starting with low energy and working up to the normal emission level. This is useful to limit, at first, the amount of outgassing that occurs because a larger amount of outgassing is expected on the first conditioning phase. It is appreciated that the ramping may occur over continuous voltage levels or may occur over selected discrete levels.

In one implementation, at step 1050 (FIG. 12), the positive bias voltage is then maintained at the second predetermined value, as shown in the timing diagram 1230 of FIG. 15 as region 1260. This may occur over a period of 1 hour, in one example, until the duration completes 1060. In one implementation, the positive bias voltage applied at steps 1040–1050 is a DC level. In an alternative implementation, the bias voltage applied to the gate at steps 1040–1050 is pulsed. In accordance with one variation, the emitters of a given row are biased during that row's on-time with the rows being sequentially activated, row-by-row (e.g., sequential scanning). In this way, only one row is active at a time.

Figure 13:
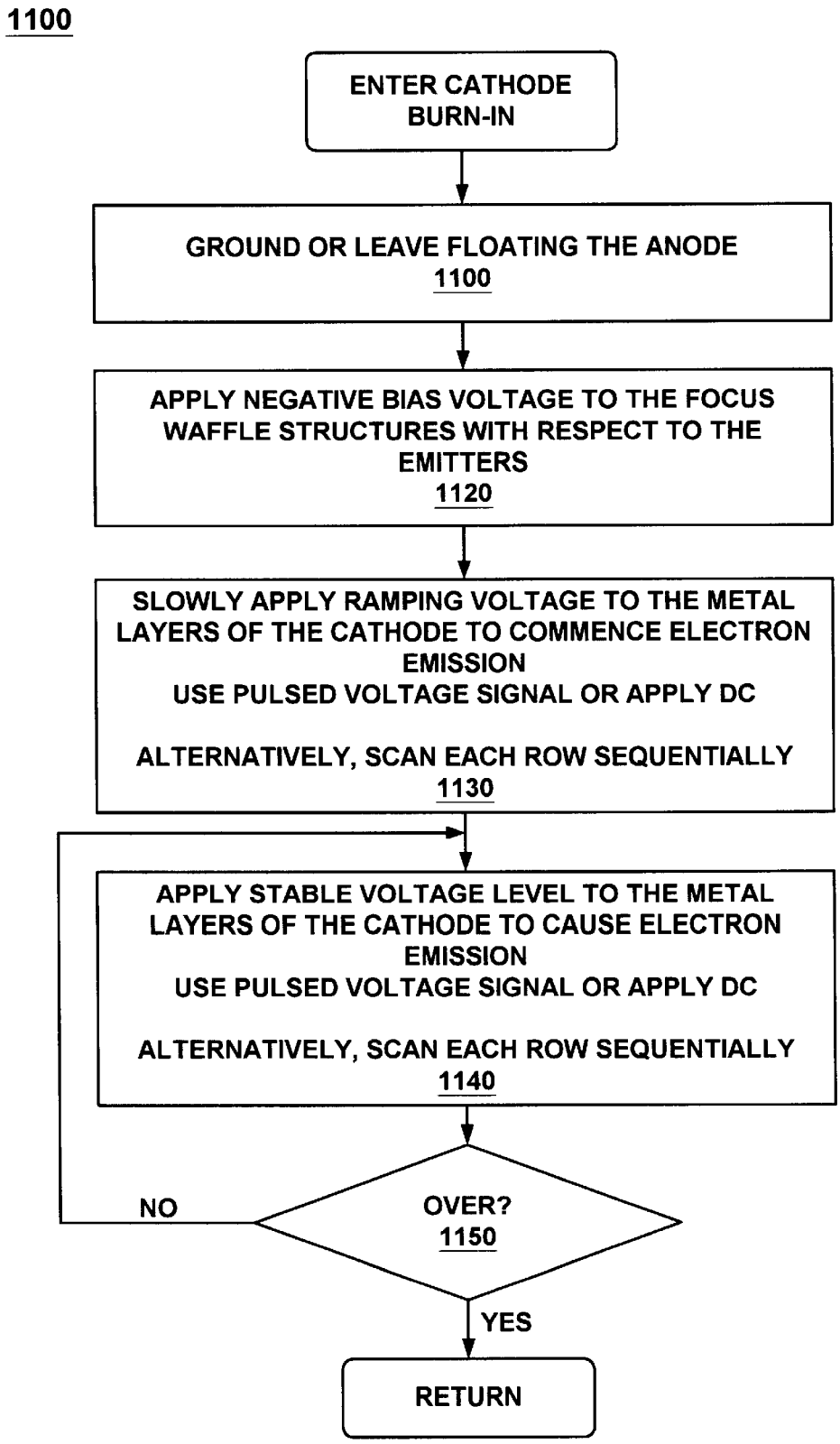
FIG. 13 is a flow diagram of steps performed by a second embodiment of the present invention for performing cathode burn-in conditioning that avoid display non-uniformities near and around the spacer walls.

FIG. 13 illustrates a cathode conditioning process 1100 in accordance with a second embodiment of the present invention. Refer to FIG. 13 and FIG. 11. According to this embodiment, during cathode burn-in, electrons are directed toward the M2 layer of the cathode, e.g., paths 1040*a–b*, and are not allowed to exit the focus well 11. In this way, electrons emitted from emitter 40 do not reach the spacer walls 1020.

According to process 1100, at step 1110 the anode electrode (e.g., faceplate) is either allowed to float or it is grounded. Either condition may be done. At step 1120, a negative bias voltage is applied to the focus waffle structure 10 with respect to the M1 layer of the emitter. This negative bias voltage, in one implementation, may be approximately 20 volts or more. It is appreciated that steps 1110 and 1120 may be performed in any order or may occur simultaneously. Under these conditions, the negative focus voltage pinches off the potential at the top of the focus waffle structure so that no electrons can escape out to hit the faceplate or wall. As a result, the electrons return to the M2 layer of the gate.

At steps 1130 and 1140 the emitters are biased (e.g., energized) so that electrons are emitted from the emitter in accordance with cathode burn-in. During the initial cathode conditioning process, these steps may be lengthy, e.g., about 1 hour in duration. These steps 1130 and 1140 may be performed analogously to steps 1040 and 1050 of FIG. 12.

Figure 14:
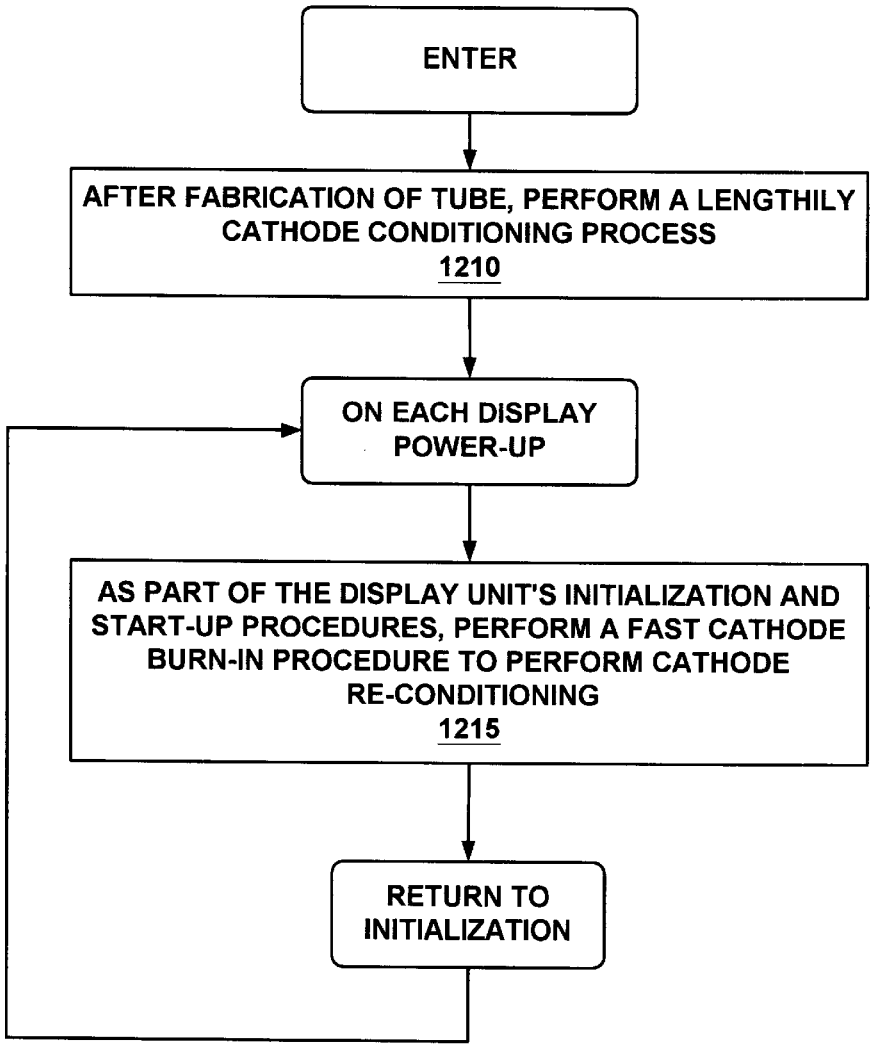
FIG. 14 is a flow diagram illustrating that the cathode burn-in conditioning processes of FIG. 12 and FIG. 13 can be performed at device start-up to perform cathode re-conditioning.

FIG. 14 illustrates a cathode conditioning process 1200 that includes a conditioning process 1210 and a re-conditioning process 1215 that may be performed periodically over the lifetime of the FED screen, e.g., on each time the FED screen is powered-on. The conditioning process of step 1210 may be either of the processes performed in FIG. 12 or FIG. 13. It is typically performed at the factory and is done to condition the cathode before it is used for normal display operations. As discussed, it typically requires about 1 hour to complete.

Step 1215 is a cathode reconditioning step that may be performed periodically. For example, step 1215 can be performed each time the FED screen is powered on and may be implemented as part of the screen's normal initialization or start-up sequence. It is appreciated that the same steps as shown in FIG. 12 or FIG. 13 may be used to implement process 1215 except that the entire reconditioning process is reduced to a duration of less than 1 second.

The present invention, method for performing cathode burn-in with respect to an FED display that avoids display non-uniformities near and around the spacer wall structures, has thus been disclosed. It should be appreciated that electronic circuits for implementing the present invention, particularly the circuits for delaying the activation of the emissive cathode until a threshold voltage potential has been established, are well known. For instance, it should be apparent to those of ordinary skill in the art, upon reading the present disclosure, that a control circuit responsive to electronic control signals may be used to sense the anode voltage and to turn on the power supply to the row and column drivers after the anode voltage has reached a threshold value. It should also be appreciated that, while the present invention has been described in particular embodiments, the present invention should not be construed as limited by such embodiments, but rather construed according to the below claims.

What is claimed is:

1. In a field emission display device comprising: rows and columns of pixels; an anode electrode; and a focus waffle structure, wherein each of said pixels comprises respective emitter and gate electrodes, a method for performing cathode conditioning comprising the steps of:

a) biasing said focus waffle structure with a positive voltage with respect to said emitter electrode;

b) biasing said anode electrode with a voltage level that is floating or negative; and c) biasing said emitter electrode such that electrons are emitted from tips of said emitter electrode, wherein said emitted electrons are directed toward said focus waffle structure.

2. A method as described in claim 1 wherein said positive voltage of said step a) is within the range of approximately 40 to 100 volts.

3. A method as described in claim 1 wherein said anode electrode is biased to a negative voltage level within the range of approximately 100 to 500 volts at said step b).

4. A method as described in claim 1 wherein said emitter electrode comprises a first metal layer and a second metal layer and wherein said step c) comprises the step of applying a voltage of approximately 30 volts across said first and second metal layers.

5. A method as described in claim 1 wherein said focus waffle structure comprises a focus well having a 2:1 aspect ratio as expressed width to height.

6. A method as described in claim 1 wherein said field emission display device further comprises spacer walls disposed between said anode electrode and said focus waffle structure and wherein said biasing of step c) causes said electrons emitted from said tips of said emitter electrode to also be substantially energetically restricted from reaching any substantial portion of said spacer walls.

7. A method as described in claim 6 wherein said step c) is performed using a pulsed voltage bias signal applied to said emitter electrode.

8. A method as described in claim 6 wherein said step c) is performed using a direct current (DC) bias voltage signal applied to said emitter electrode.

9. A method as described in claim 6 wherein said step c) is performed in accordance with a sequential row-by-row scan wherein only one row of emitter electrodes is biased at any one time.

10. A method as described in claim 1 wherein said emitter electrode comprises a first metal layer and a second metal layer and wherein said step c) comprises the steps of:

c1) over a first time period, ramping a bias voltage applied across said first and second metal layers from a first predetermined level to a second predetermined level; and c2) over a second time period, maintaining said second predetermined level.

11. A method as described in claim 10 wherein said first predetermined level is approximately 20 volts and wherein said second predetermined level is approximately 30 volts.

12. A method as described in claim 10 wherein said first time period is approximately 5 minutes and wherein said second time period is approximately 1 hour.

13. A method as described in claim 6 further comprising the step of measuring said first and second predetermined levels based on emission current collected on said focus waffle structure.

14. In a field emission display device comprising: rows and columns of pixels; an anode electrode; a focus waffle structure, and wherein each of said pixels comprises respective emitter and gate electrodes, a method for performing cathode conditioning comprising the steps of:

a) biasing said focus waffle structure with a negative voltage with respect to said emitter electrode;

b) biasing said anode electrode with a voltage level that is floating or grounded; and c) biasing said emitter electrode such that electrons are emitted from tips of said emitter electrode, wherein said emitted electrons are directed toward said gate electrode.

15. A method as described in claim 14 wherein said field emission display device further comprises spacer walls disposed between said anode electrode and said focus waffle structure and wherein said biasing of step c) further causes said emitted electrons to be substantially energetically restricted from reaching any substantial portion of said spacer walls.

16. A method as described in claim 15 wherein said negative voltage of said step a) is within the range of approximately 20 volts or more.

17. A method as described in claim 15 wherein said emitter electrode comprises a first metal layer and a second metal layer and wherein said step c) comprises the step of applying a voltage of approximately 30 volts across said first and second metal layers.

18. A method as described in claim 15 wherein said focus waffle structure comprises a focus well having a 2:1 aspect ratio as expressed width to height.

19. A method as described in claim 15 wherein said step c) is performed using a pulsed bias voltage signal applied to said emitter electrode.

20. A method as described in claim 15 wherein said step c) is performed using a direct current (DC) bias voltage signal applied to said emitter electrode.

21. A method as described in claim 15 wherein said step c) is performed in accordance with a sequential row-by-row scan wherein only one row of emitter electrodes is biased at any one time.

22. A method as described in claim 15 wherein said emitter electrode comprises a first metal layer and a second metal layer and wherein said step c) comprises the steps of:

c1) over a first time period, ramping a bias voltage applied across said first and second metal layers from a first predetermined level to a second predetermined level; and c2) over a second time period, maintaining said second predetermined level.

23. A method as described in claim 22 wherein said first predetermined level is approximately 20 volts and wherein said second predetermined level is approximately 30 volts.

24. A method as described in claim 22 wherein said first time period is approximately 5 minutes and wherein said second time period is approximately 1 hour.

25. A method as described in claim 22 further comprising the step of measuring said first and second predetermined levels based on emission current collected on said focus waffle structure.

26. In a field emission display device comprising: rows and columns of pixels; an anode electrode; a focus waffle structure and, wherein each of said pixels comprises respective emitter and gate electrodes, a method of performing cathode conditioning comprising the steps of:

performing a cathode conditioning process of a first duration before said field emission display device is used for normal display operations; and upon subsequent normal power-on of said field emission display device, performing cathode re-conditioning process of a second duration, wherein said second duration is significantly shorter than said first duration.

27. A method as described in claim 26 wherein said field emission display device further comprises spacer walls disposed between said anode electrode and said focus waffle structure.

28. A method as described in claim 27 wherein said cathode conditioning and re-conditioning processes each comprise the steps of:

a) biasing said focus waffle structure with a negative voltage with respect to said emitter electrode;

b) biasing said anode electrode with a voltage level that is floating or grounded; and c) biasing said emitter electrode such that electrons are emitted from tips of said emitter electrode, wherein said emitted electrons are directed toward and gate electrode and are substantially energetically restricted from reaching any substantial portion of said spacer walls.

29. A method as described in claim 27 wherein said negative voltage of said step a) is within the range of approximately 20 volts or more.

30. A method as described in claim 27 wherein said emitter electrode comprises a first metal layer and a second metal layer and wherein said step c) comprises the step of applying a voltage of approximately 30 volts across said first and second metal layers.

31. A method as described in claim 27 wherein said cathode conditioning and re-conditioning processes each comprise the steps of:

a) biasing said focus waffle structure with a positive voltage with respect to said emitter electrode;

b) biasing said anode electrode with a voltage level that is floating or negative; and c) biasing said emitter electrode such that electrons are emitted from tips of said emitter electrode, wherein said emitted electrons are directed toward said focus waffle structure and are energetically forbidden from reaching any substantial portion of said spacer walls.

32. A method as described in claim 31 wherein said positive voltage of said step a) is within the range of approximately 40 to 100 volts.

33. A method as described in claim 31 wherein said anode electrode is biased to negative voltage level within the range of approximately 100 to 500 volts.

* * * * *